US007556072B2

(12) United States Patent
Koch, Jr.

(10) Patent No.: US 7,556,072 B2
(45) Date of Patent: Jul. 7, 2009

(54) LOG SPLITTING APPARATUS AND METHOD FOR ITS USE

(76) Inventor: Edward Koch, Jr., 1533 W. Beck La., Phoenix, AZ (US) 85023

( * ) Notice: Subject to any disclaimer, the term of this patent is extended or adjusted under 35 U.S.C. 154(b) by 0 days.

(21) Appl. No.: 11/733,622

(22) Filed: Apr. 10, 2007

(65) Prior Publication Data

US 2008/0251158 A1 Oct. 16, 2008

(51) Int. Cl.
*B27L 7/06* (2006.01)

(52) U.S. Cl. ..... 144/366; 144/193.2; 144/195.1

(58) Field of Classification Search ..... 144/193.2, 144/195.1, 195.7, 195.8, 195.9, 366, 193.1; 60/430

See application file for complete search history.

(56) References Cited

U.S. PATENT DOCUMENTS

| | | | | | |
|---|---|---|---|---|---|
| 2,851,072 | A | * | 9/1958 | Gerjets et al. | 144/193.1 |
| 4,112,985 | A | * | 9/1978 | Gosselin | 144/195.1 |
| 4,615,366 | A | * | 10/1986 | Scarbrough, Jr. | 144/195.1 |
| 4,782,868 | A | * | 11/1988 | Coller et al. | 144/195.1 |
| 5,575,319 | A | * | 11/1996 | Chick | 144/195.4 |
| 5,946,912 | A | | 9/1999 | Hung | |

OTHER PUBLICATIONS

Northern Industrial Horizontal Log Splitter-10 Ton, Manual Hydraulic from the web site of www.northerntool.com (1 page). This reference was known to the applicant prior to the filing date.

Sears, Roebuck and CO, Owner's Manual Craftsman 10 Ton Hydraulic Log Splitter, Model No. 486,24540, Hoffman Estates, Illinois 60179, U.S.A., form No. 49668, pp. 1-8, Feb. 2005.

Five pages from web site of minisplitters.com from http://archive.org/index.php. This reference was known to the applicant prior to Apr. 10, 2007.

Twenty pages from web site of Harborfreight.com from http://www.archive.org/index.php. This reference was known to the applicant prior to Apr. 10, 2007.

Six pages from web site of omegastores.com from http://www.archive.org/index.php. This reference was known to the applicant prior to Apr. 10, 2007.

NorthStar 3-Point Horozontal/Vertical Log Splitter web pages (6 pages). This reference was known to the applicant prior to Apr. 10, 2007.

Split Decision, Popular Mechanics, Sep. 2005, p. 37.

Two Speed, 10 Ton Hydraulic Log Splitter from web site of Harborfreight.com (1 page). This reference was known to the applicant prior to Apr. 10, 2007.

Northern Industrial Horizontal Log Splitter-10 Ton, Manual Hydraulic from the web site of www.northerntool.com (1 page). This reference was known to the applicant prior to Apr. 10, 2007.

* cited by examiner

*Primary Examiner*—Shelley Self
(74) *Attorney, Agent, or Firm*—Jennings, Strouss & Salmon, P.L.C.; Joseph W Mott

(57) ABSTRACT

An apparatus and methods for splitting logs includes a hydraulic power unit, for driving a wedge against a log, held in a fixed position, between the wedge and an anvil. The hydraulic power unit is manually powered, and can provide driving forces at two different speeds, depending on the loads encountered during a log splitting operation.

13 Claims, 22 Drawing Sheets

LOG SPLITTING APPARATUS AND METHOD FOR ITS USE

TECHNICAL FIELD

The disclosed subject matter details an apparatus and methods for splitting whole logs (rounds) and previously split rounds. The apparatus accommodates logs, which may be split into partial rounds to make firewood and split into even smaller portions to make kindling wood.

BACKGROUND

As heating fuel prices continue to escalate, people are turning to alternate heating sources, such as wood. In order to properly size raw wood for a woodstove or fireplace, it must typically be split into useable portions or pieces.

Wood splitting is typically performed either manually with axes, wedges, hammers, mauls and other manual tools, or with engine and electric motor powered machines. Manual tools are typically heavy, such that use of these tools requires a strong and fit individual. Engine powered machines require a source of fuel. Electric machines require an external power source. In any case, the user must be experienced with these tools and machines, for they are also dangerous devices, which if not used properly, can result in injury or death.

SUMMARY

The disclosed subject matter describes an apparatus and methods for splitting logs (rounds) into firewood and kindling. The apparatus is safe and easy to operate. It includes manually operated components, which do not require great physical strength, experience, or special training to operate. The apparatus does not require heavy lifting or the use of heavy and dangerous tools. The apparatus is environmentally friendly, since it operates without burning fossil fuels or without the use of electric power, and is not noisy, as are engine powered log splitters.

The apparatus incorporates a manually operated hydraulic power unit to drive a wedge against a log, which is held in a fixed position between the wedge and an adjustable stop, herein referred to as the anvil. The hydraulic power unit can provide driving force at two different force levels and speeds, depending on the load encountered by the power unit at the specific stage of the log splitting operation being performed. This manually powered, hydraulic machine is typically more powerful than comparable electric motor powered machines. The apparatus can split logs for long periods, without ever having to be refueled, as an engine powered machine has to be. The apparatus is able to accommodate various log diameters, for example, up to 24 inches in diameter and log lengths up to 24 inches long. These logs may then be split into firewood size portions and then into kindling wood, as desired.

The apparatus is compact and stores upright in a vertical orientation. Accordingly, it has a small storage footprint. The apparatus is portable, and is easily moved between work sites, by either being pulled manually on its wheels or by being towed by a vehicle, similar to that of an automobile trailer.

The disclosed subject matter is directed to a log splitting apparatus. The apparatus includes a frame for supporting an anvil and a power unit, for example, a hydraulic power unit formed of multiple pumps. The frame is formed of a backbone. There is a wedge for contacting and splitting a log or log portion (also known collectively as a "round"), and a power unit for driving the wedge. There is also an anvil for restraining movement of the log or log portion, placed onto the apparatus for splitting. The anvil is slideable along the backbone until secured in place on the backbone.

The disclosed subject matter is directed to a log splitting apparatus having a frame for supporting an anvil and a hydraulic power unit. The frame has a backbone. There is a wedge for contacting and splitting a log or log portion (also known collectively as a "round"). The hydraulic power unit for driving the wedge is formed of a pump unit, for example, of multiple pumps, for pumping at least at two different speeds by a single actuation of the pump unit, via a single handle. The pumping drives the wedge at speeds corresponding to the pumping speeds. There is also an anvil for restraining movement of the log or log portion placed onto the apparatus for splitting. The pump unit is, for example, formed of two pumps, one being a small chamber pump and the other being a large chamber pump.

The disclosed subject matter is directed to a log splitting apparatus having a frame for supporting an anvil, for restraining movement of a (also known collectively as a "round"), and a hydraulic power unit. The frame has a backbone. There is a wedge for contacting and splitting the log or log portion. The hydraulic power provides power to drive the wedge, and includes a pump unit and a switch unit. The pump unit pumps hydraulic fluid (oil) at two different speeds by a single actuation of the pump unit, with, for example, a single handle. The switch unit for controls the pumping by the pump unit, and includes a regulating member, such as a valve, for example, a spring-loaded ball check valve, that is movable between a first position and a second position. The first position is such that the pump unit is pumping at a first speed prior to a predetermined load being encountered by the wedge, and the pump unit is pumping at a second speed once the predetermined load has been encountered. The second position is such that the pump unit is pumping at the first speed, irrespective of the load being encountered by the wedge. The predetermined load, for example, corresponds to the force required to move the check ball, of the check ball valve, as held in position by the force (loading) of the spring on the check ball. The pump unit is, for example, formed of two pumps, one being a small chamber pump and the other being a large chamber pump. Also, for example, pumping is at the first speed when two pumps are pumping the wedge, and the second speed when only one pump, typically the small chamber pump, is pumping the wedge. The first speed is typically faster than the second speed.

The disclosed subject matter is directed to a method for splitting a log or log portion (also known collectively as a "round") by providing a log splitting apparatus. The log splitting apparatus has a frame for supporting an anvil and a power unit. The frame has a backbone. There is also a wedge for contacting and splitting the log or log portion. There is a power unit for driving the wedge, and an anvil for restraining movement of a log or log portion. The anvil is slideable along the backbone until secured in place on the backbone. With the apparatus provided, the anvil is moved to a desired position, where it is secured along the backbone. A log or log portion is placed into contact with the anvil, and typically also the backbone. The power unit is activated to drive the wedge into contact with the log or log portion. The power unit continues to be activated to split the log or log portion, with activation continuing until the log or log portion is split into multiple pieces.

The disclosed subject matter is directed to a method for splitting a log or log portion (also known collectively as a "round") by providing a log splitting apparatus. The apparatus includes a frame for supporting an anvil, for restraining movement of the log or log portion, and a power unit. The frame has a backbone. There is a wedge for contacting and splitting the log or log portion. There is a hydraulic power unit for driving the wedge, that includes a pump unit and a switch unit. The pump unit is for pumping at two different speeds by a single actuation of the pump unit, and for driving the wedge at speeds corresponding to the pumping speeds. The switch unit controls the pumping by the pump unit, and includes a regulating member, that is movable between a first position and a second position. In the first position, the pump unit is pumping at a first speed prior to a predetermined load being encountered by the wedge, and the pump unit is pumping at a second speed once the predetermined load has been encountered. In the second position, the pump unit is pumping at the first speed, irrespective of the load encountered by the wedge, and the first speed faster than the second speed. A log or log portion is then placed into contact with the anvil, typically on the backbone, and the regulating member is moved to the first position. The power unit is activated, to drive the wedge into contact with the log or log portion, to create a split in the log or log portion. The regulating member is then moved to the second position once the split has been created and the power unit continues to be activated to drive the wedge.

BRIEF DESCRIPTION OF THE DRAWINGS

Attention is now directed to the drawings, where like reference numerals or characters indicate corresponding or like components. In the drawings.

DETAILED DESCRIPTION OF THE DRAWINGS

Figure 1A:
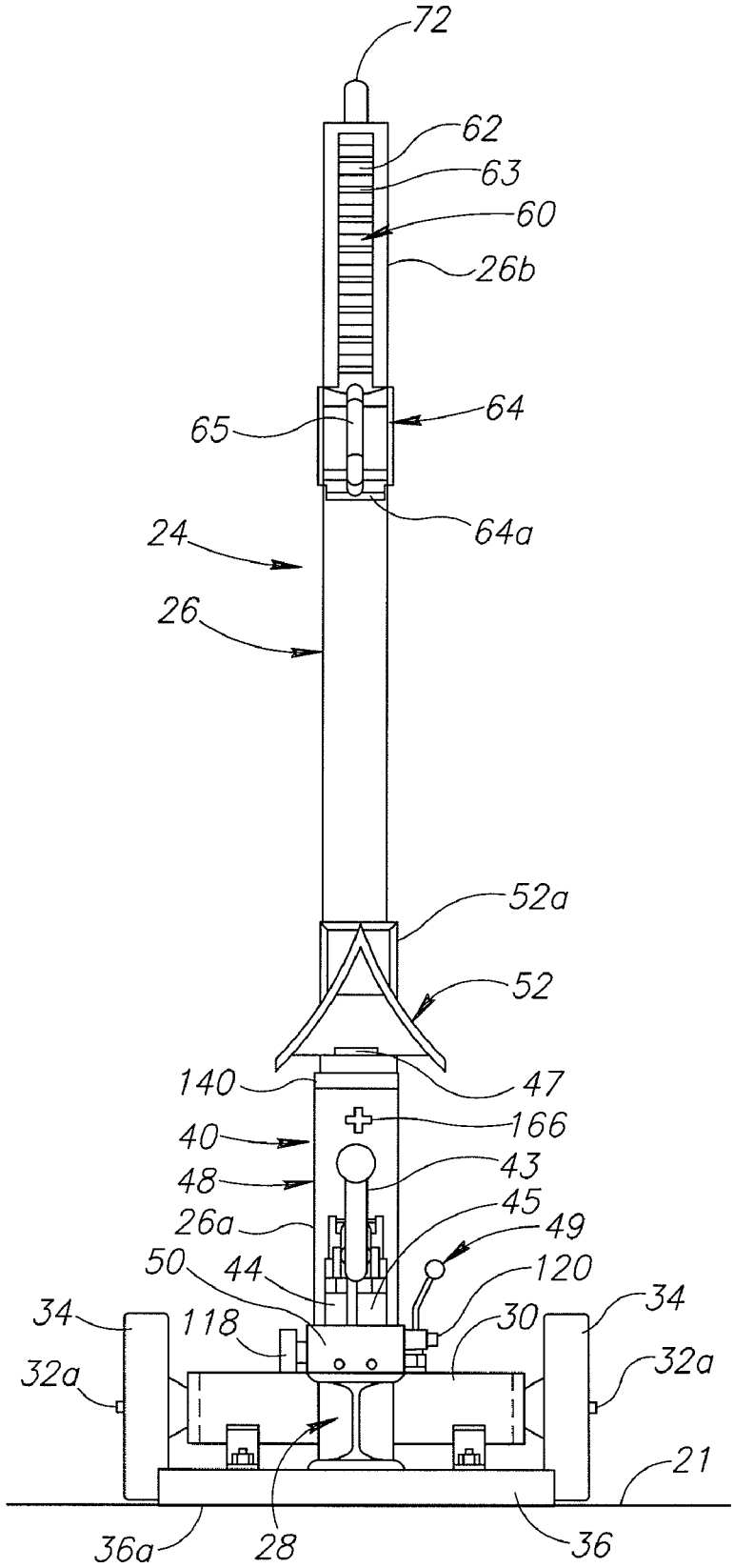
FIG. 1A is a front view of the apparatus in an upright or vertical orientation.

FIGS. 1A-1C and FIG. 2 show the apparatus 20 in a kindling splitting or storage position, as the apparatus 20 is in a vertical orientation with respect to the ground surface 21. The apparatus 20 is formed of a frame 24, that is, for example "L" shaped. The frame 24 includes a backbone 26, for example, an I-beam, and a frame base 28, also, for example, a wide flange I-beam, at a first end 26*a* of the backbone 26. The frame base 28 is typically oriented perpendicular or substantially perpendicular, to the backbone 26. A flat bar 30 attaches to the backbone 26 on the side opposite the side of the frame base 28. The flat bar 30 supports an axle 32, to which wheels 34 attach at the ends 32*a* of the axle 32.

Support members 36, 37, are typically joined to the frame base 28 on its outer side, 28*a*, for contact with the ground surface 21, when in the upright orientation of FIG. 1A. The ground contacting surfaces 36*a*, 37*a* of these support members 36,37, typically define a plane (P), that is slightly below the wheels 34, such that when in the upright orientation, the wheels 34 remain out of contact with the ground surface 21. The wheels 34 can be made to contact the ground surface 21 by using the machine handle 72 to rotate the machine 20 around the rear lower edge 37*b* of the support member 37.

The frame base 28 supports a force generating mechanism, for example, a hydraulic power unit 40, that includes a yoke or sleeve 42 (for example, of metal or the like) which receives a pumping handle 43 (for example, of metal or the like) typically angled to accommodate operation in the horizontal mode and the vertical mode of operation of apparatus 20, as detailed below). The handle 43 drives pumps 44, 45, that in turn, drive a piston 46 (FIG. 6), to which a ram 47, housed in a pressure tube 146, is attached. The hydraulic power unit 40 also includes a pressure switch 130 that facilitates pumping of the piston 46, at two different speeds, depending on the load being encountered or the splitting operation (or stage thereof) being performed (detailed below). The casing 48 is supported on a base 50, and is typically joined thereto by mechanical or other attachments. The ram 47 pushes on the base of a wedge 52, that contacts the logs when in operation (FIGS. 11A-11C and 12, detailed below). A wedge guide 52*a* to which the wedge 52 is fastened, slides freely up and down on the front face of the backbone 26.

Figure 11A:
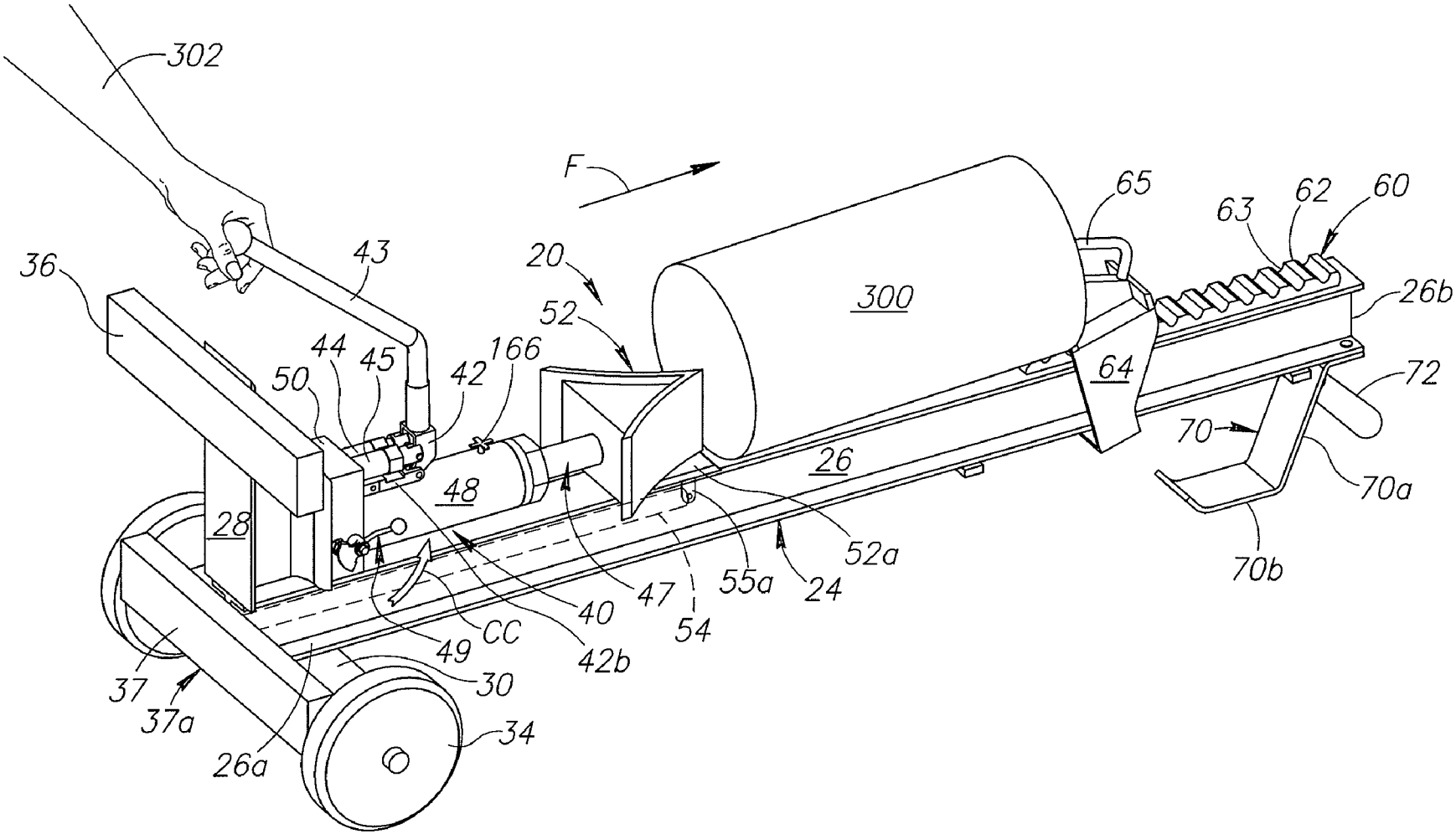
FIGS. 11A-11C are perspective views showing the apparatus of FIGS. 1A-1C and FIG. 2, in operation splitting a log; and, FIG. 12 is a perspective view showing the apparatus of FIGS. 1A-1C and FIG. 2 in operation creating kindling wood from a split portion of a log.
Figure 11B:
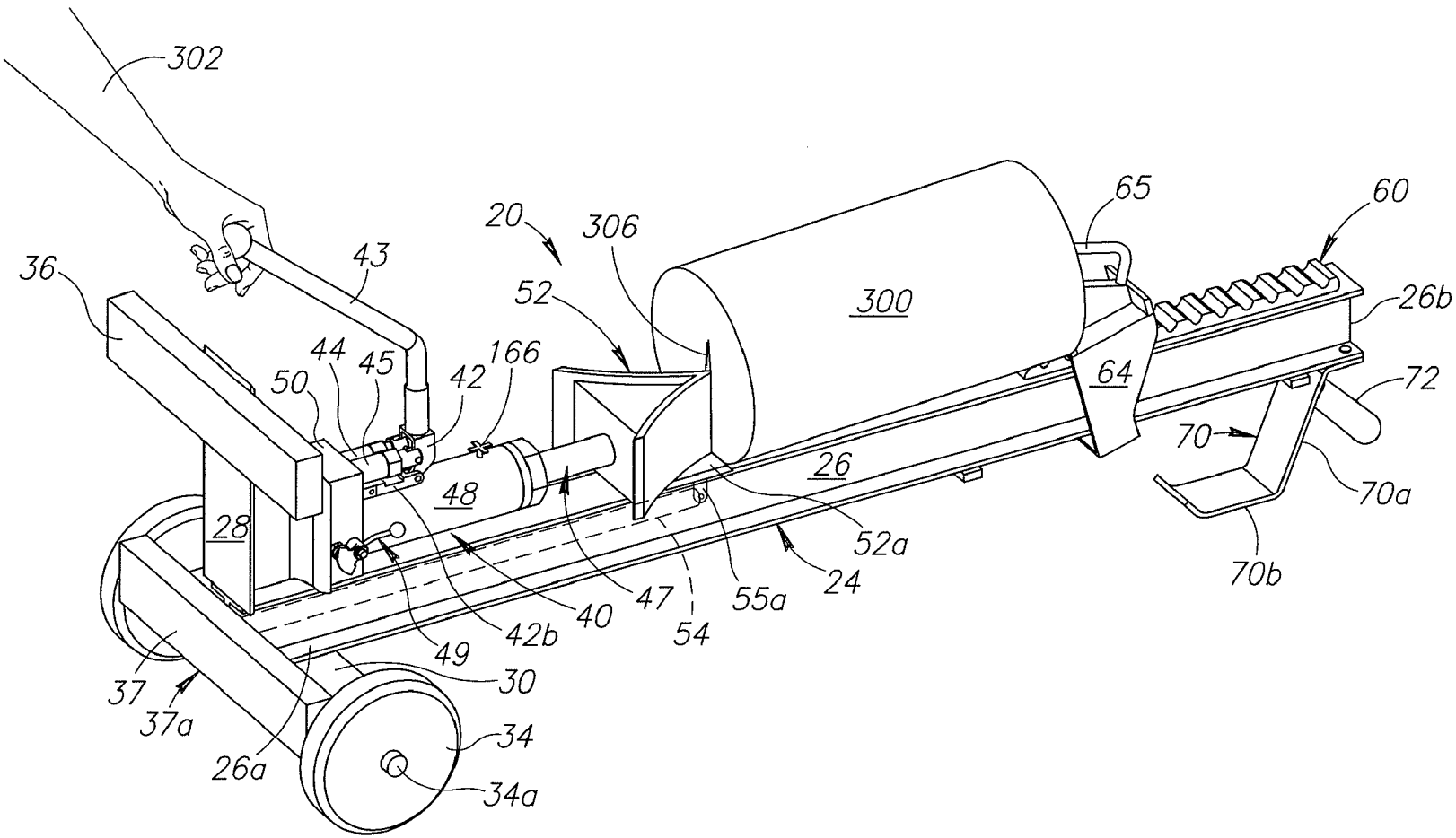
Figure 11C:
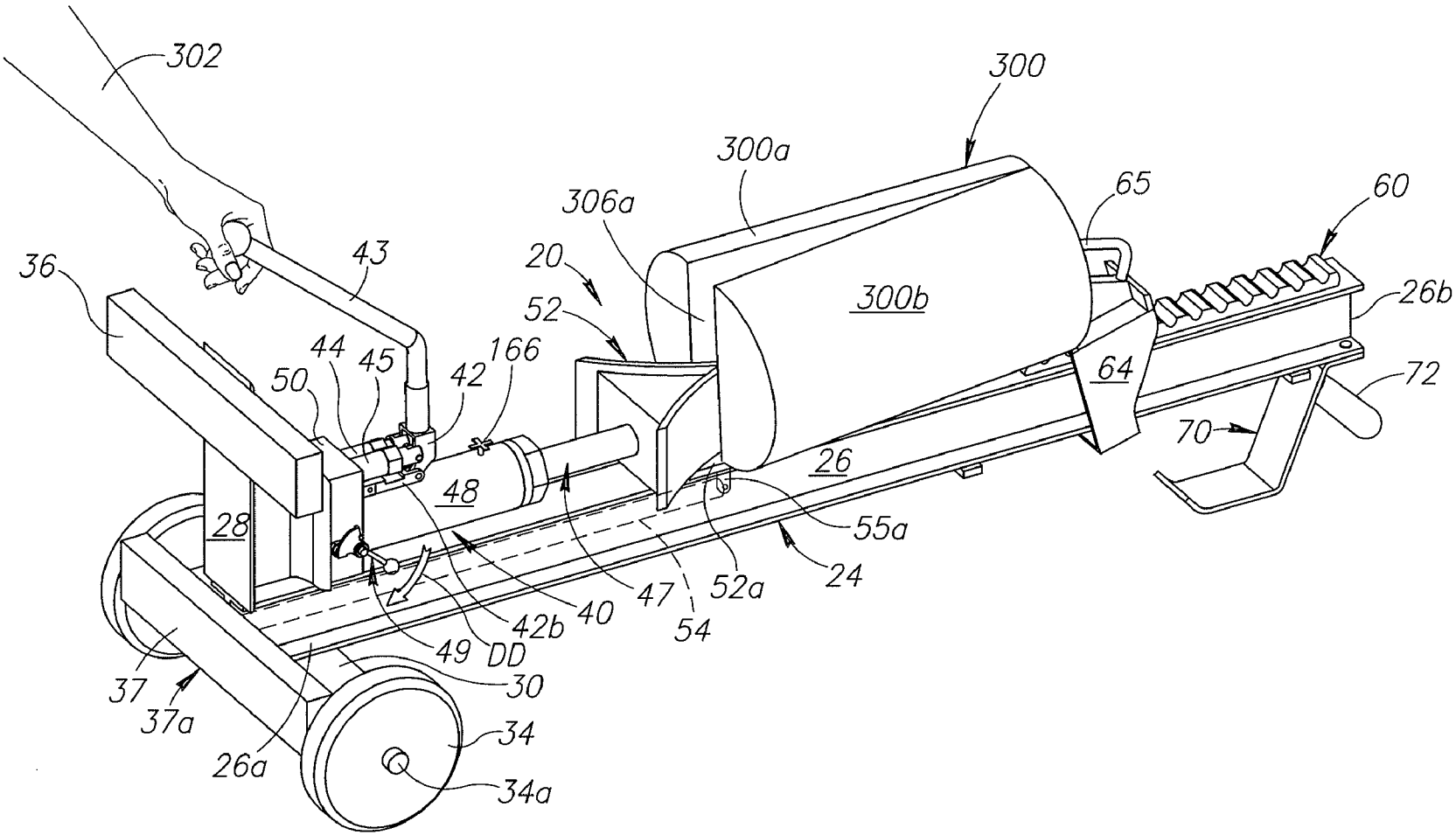

Return springs 54 are attached to the wedge guide 52*a* and the backbone 26 by tabs 55*a* on the wedge guide 52*a*, and tabs 55*b* on the backbone 26, the tabs 55*a*, 55*b* on opposite sides of the backbone 26. These return springs 54 serve as a restraint on the wedge 52, from the driving forces of the ram 47 and will force the ram 47 back into the pressure tube 146, when a pressure release valve 118 is opened by the operator. The return springs 54 are for example, of metal, such as steel, and are in tension so as to pull the wedge guide 52*a* toward the frame base 28 or downward, in the direction of the first end 26*a* of the backbone 26, when the apparatus 20 is in operation in the vertical mode (FIGS. 1A-1C, FIG. 2 and FIG. 12) or in the horizontal mode (FIGS. 11A-11C)

Figure 1B:
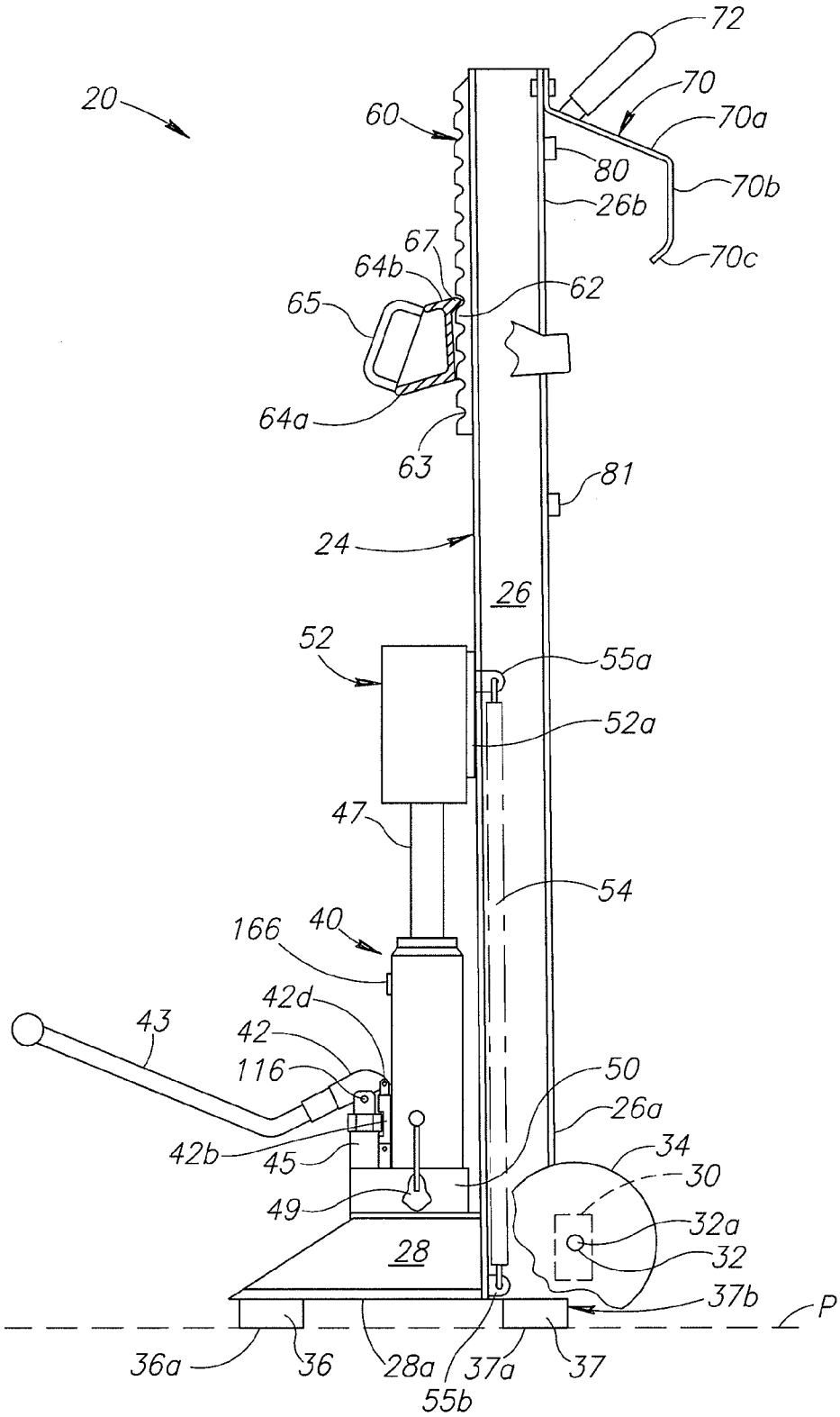
FIG. 1B is a side view of the apparatus of FIG. 1A in an upright or vertical orientation, with the ram of the hydraulic power unit extended, with partially cut-away sections at the wheel and the anvil.
Figure 1C:
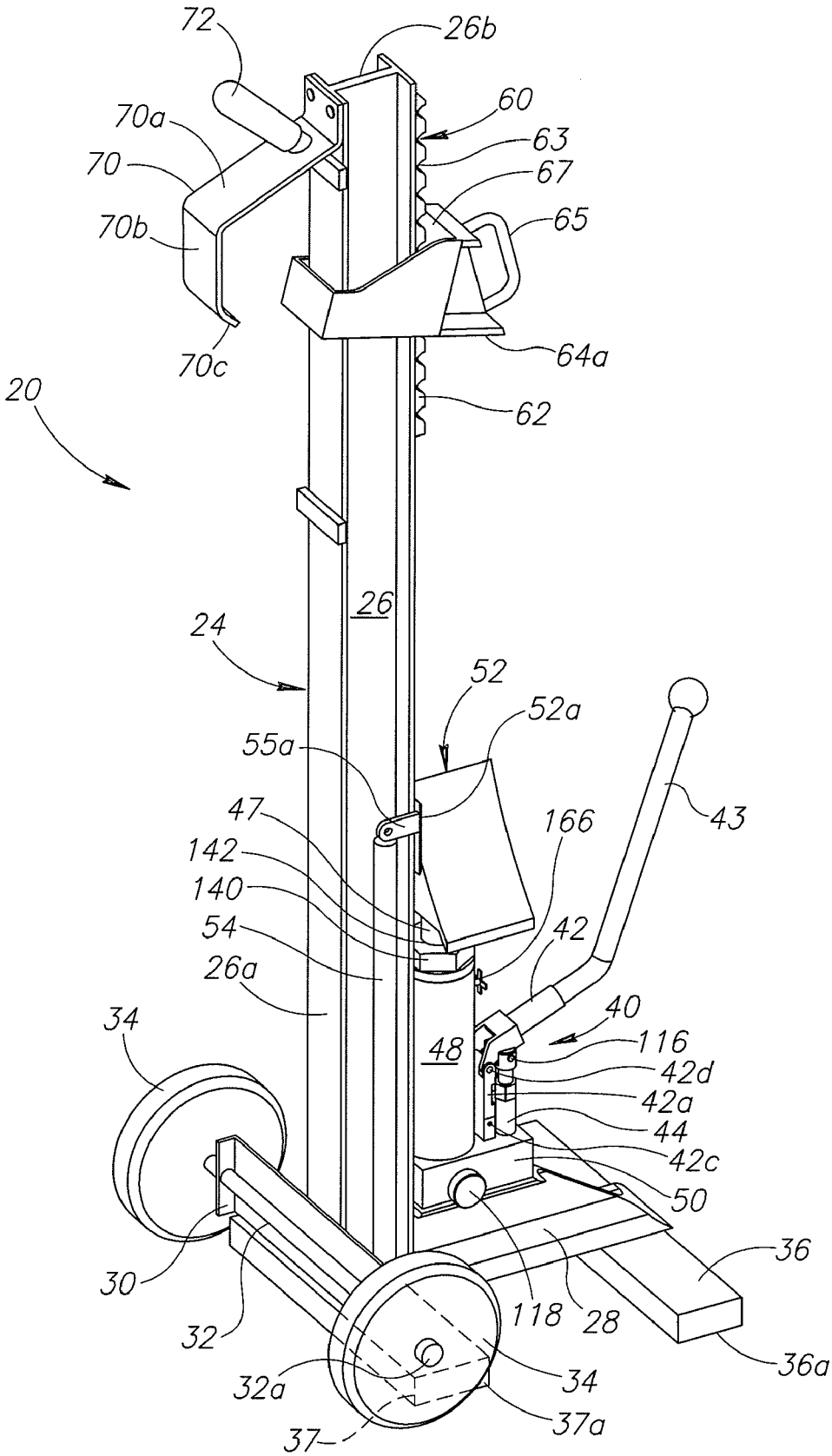
FIG. 1C is a side perspective view of the apparatus of FIG. 1A in an upright or vertical orientation.
Figure 1D:
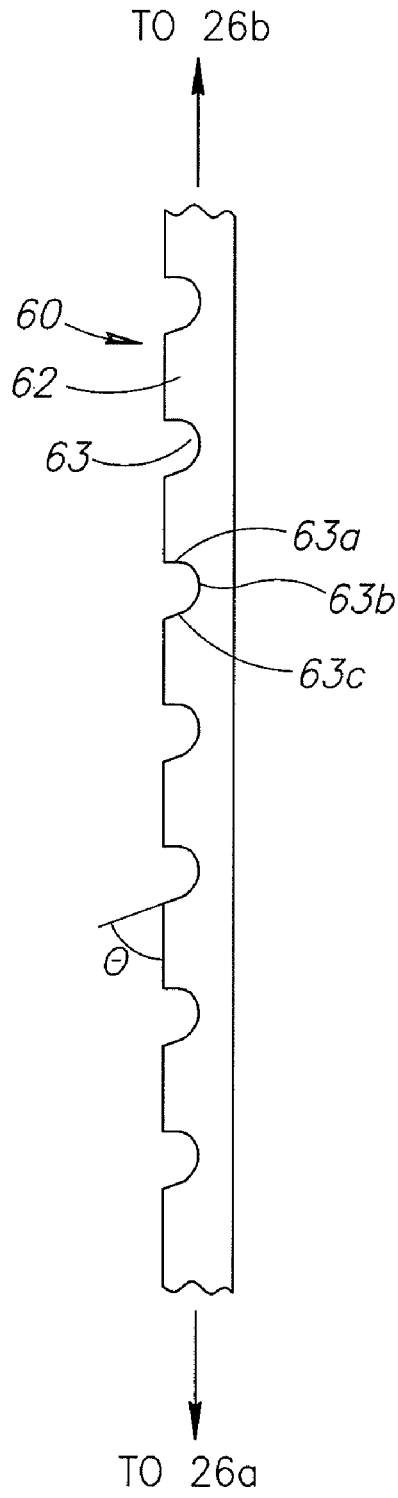
FIG. 1D is a side view of the rack of the apparatus of FIGS. 1A-1C.
Figure 3A:
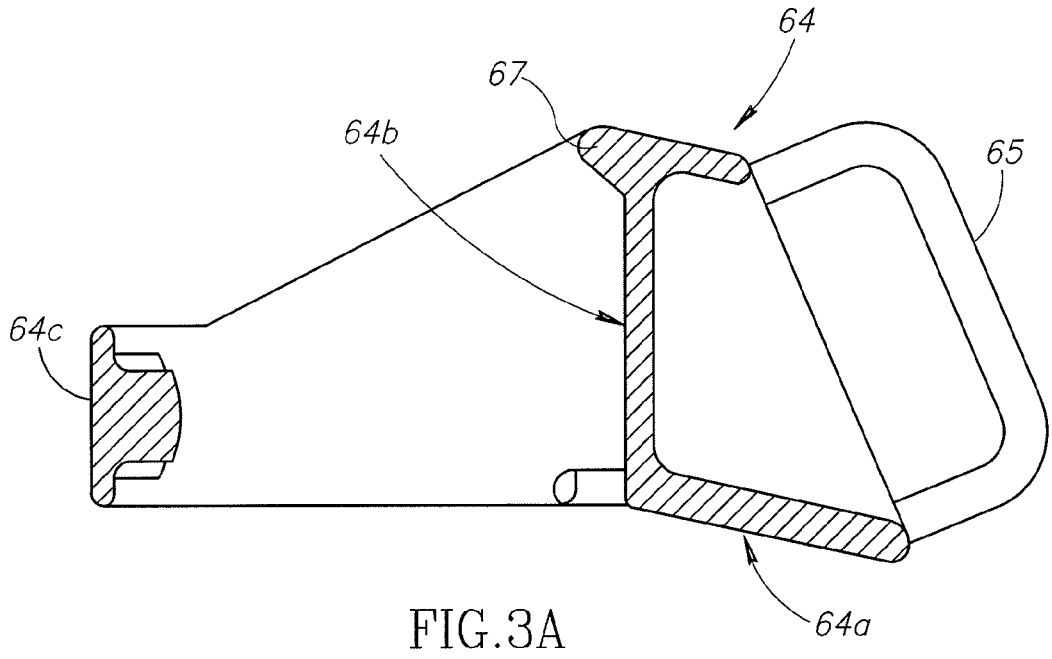
FIG. 3A is a cross sectional view of the anvil showing detail of the anvil tooth.

Turning also to FIG. 1D, a rack 60, formed of female indentations 63, extends along a portion of the backbone 26, at the second end 26*b*. An anvil 64, includes a face 64*a*, for contacting a log, when in operation. The anvil 64 also includes a handle 65, and the anvil 64 slides along the rack 60. The anvil 64, along its inner side 64*b*, includes a tooth 67 (FIG. 3A), correspondingly shaped with the indentations 63 of the rack 60, to lock the anvil 64 in the desired position, for operation. The indentations 63 on the rack 60 and the tooth 67 on the anvil 64 are configured to latch in one direction to prevent movement of the anvil 64 toward the second end 26*b* of the backbone 26.

The female indentations 63 are separated by a raised portion 62. The female indentations include a straight portion 63*a*, a rounded portion 63*b* and an angled portion 63*c*. The angled portion 63*c* is at an angle θ with respect to the vertical, with θ being, for example, approximately 70 degrees. The straight portion 63*a* serves as a stop surface for the tooth 67 on the anvil 64, preventing the anvil from moving toward the second end 26*b* of the backbone 26, even when force (in the direction of the second end 26*b*) is applied to the anvil 64, via the ram 47, as detailed below. The rounded portion 63*b* of the rack female indentation 63 facilitates engagement of the anvil 64 tooth 67 with the rack 60.

A foot 70, typically extends from the backbone 26. The foot 70 includes an intermediate portion 70*a*, from where a handle 72 extends, and a ground contacting portion 70*b*. The ground contacting portion 70*b* is typically arranged, such that its surface 70*c* contacts the ground, such that in combination with the wheels 34, orients the backbone 26 parallel to the ground surface 21, or the backbone 26 is angled slightly, such that the second end 26*b* of the backbone 26 is slightly above the first end 26*a* of the backbone 26 of the frame 24. Additionally, the second end 26*b* of the backbone 26 may be adapted to join to a trailer hitch or the like.

Figure 2:
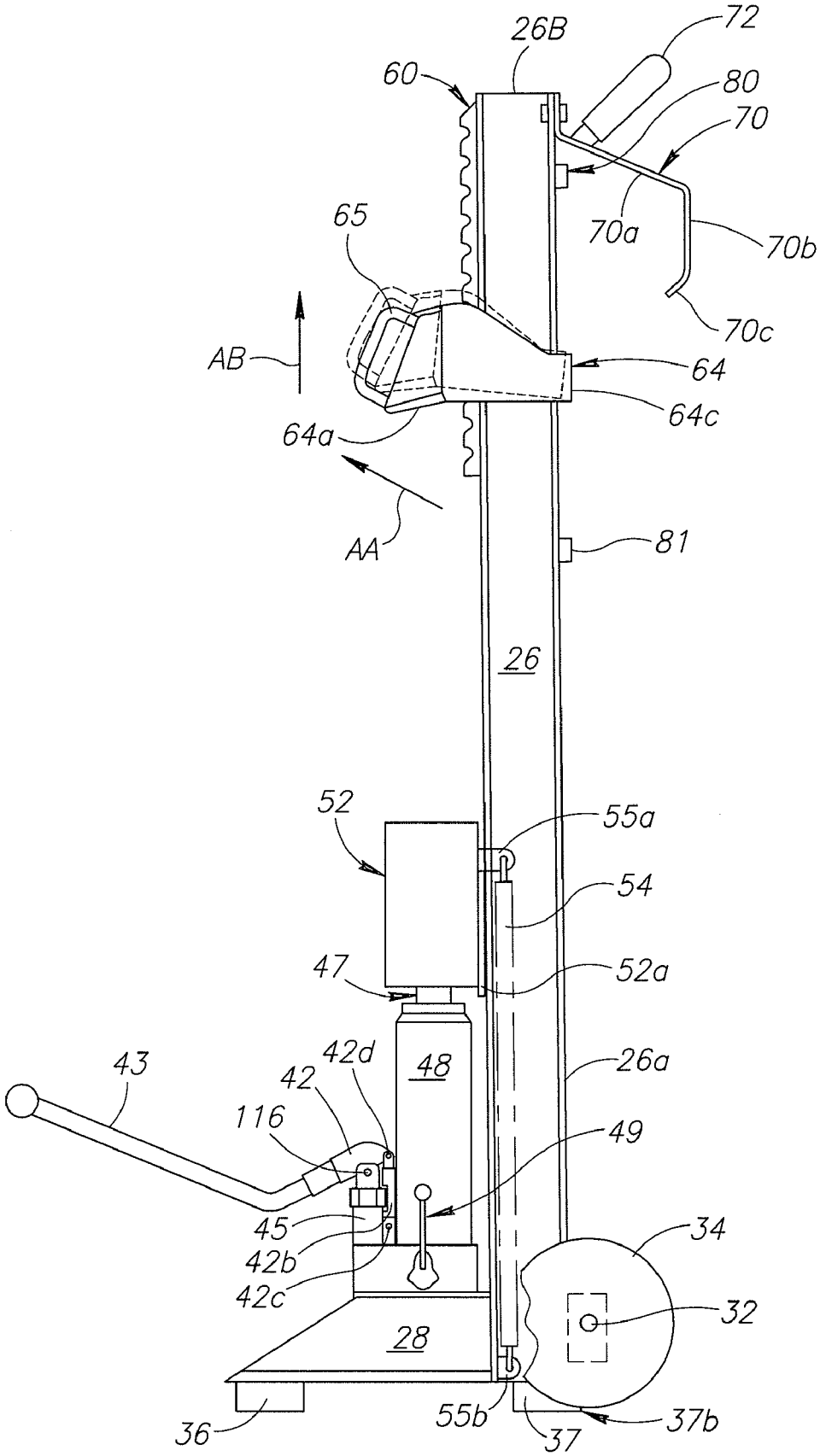
FIG. 2 is a diagram of the apparatus illustrating movement of the anvil when position adjustment is desired.

Attention is also directed to FIG. 2, where the anvil 64 and its positioning along the rack 60 are detailed. Specifically, the anvil 64 is positioned such that its end 64*c* extends beyond the backbone 26. The portion of the anvil 64 that extends beyond the backbone 26, allows the anvil 64 to be moved along the backbone 26, for example, by moving the anvil 64 outward in the direction of the arrow AA, disengaging the anvil tooth 67 from the corresponding female indentation 63 of the rack 60. The now disengaged anvil 64 (shown in broken lines) is moved upward (or downward), along the backbone 26, for example, upward, in the direction of the arrow AB, and can be moved upward or downward to the limit of the upper anvil stop 80 and the lower anvil stop 81 as desired, until moved inward on the backbone 26, such that the tooth 67 and the female indentations 63 are again engaged. Upon this engagement, the anvil 64 is again in a fixed position on the rack 60.

Figure 3B:
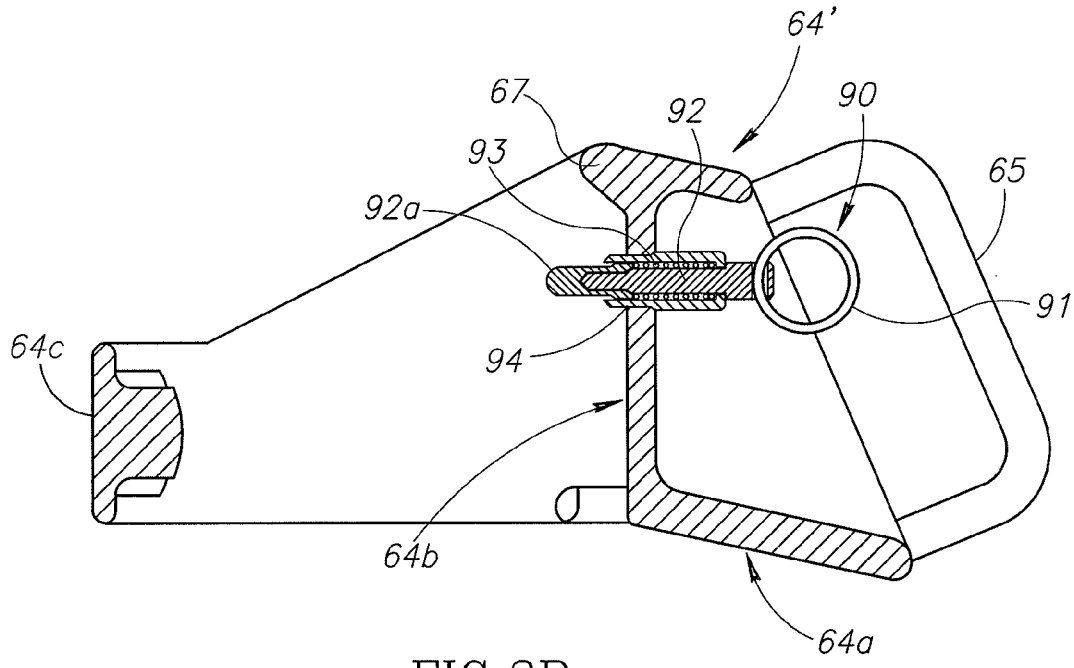
FIG. 3B is a cross-sectional view of an alternate anvil.

FIG. 3B shows an alternate anvil 64', similar in all aspects to the anvil 64, but includes a safety stop 90. The safety stop 90 is formed of a ring member 91 and a body 92, that is movable against a spring 93. The body 92 extends through an opening 94 in the inner side 64*b* of the anvil 64'. The tip 92*a* of the body is designed to engage an indentation 63 on the rack 60, when the tooth 67 is also engaging an indentation 63. The ring member 91 is pulled outward (against the biasing of the spring 93), disengaging the tip 92*a* from the indentation 63 when movement of the anvil 64' is desired.

The frame 24, including the backbone 26, frame base 28, wheel carriage assembly 30, rack 60, anvil 64, foot 70, and handle 72, and the hydraulic power unit 40, including the casings of the pumps 44, 45, piston 46, ram 47, casing 48, pressure switch handle 49, base 50, wedge 52, wedge guide 52*a* and pump pistons 114, 115, are, for example, made of hard metal, such as steel The supports 36, 37 may be made of steel, wood, or the like, and are joined to the base by conventional fasteners, such as machine screws or bolts.

Figure 4:
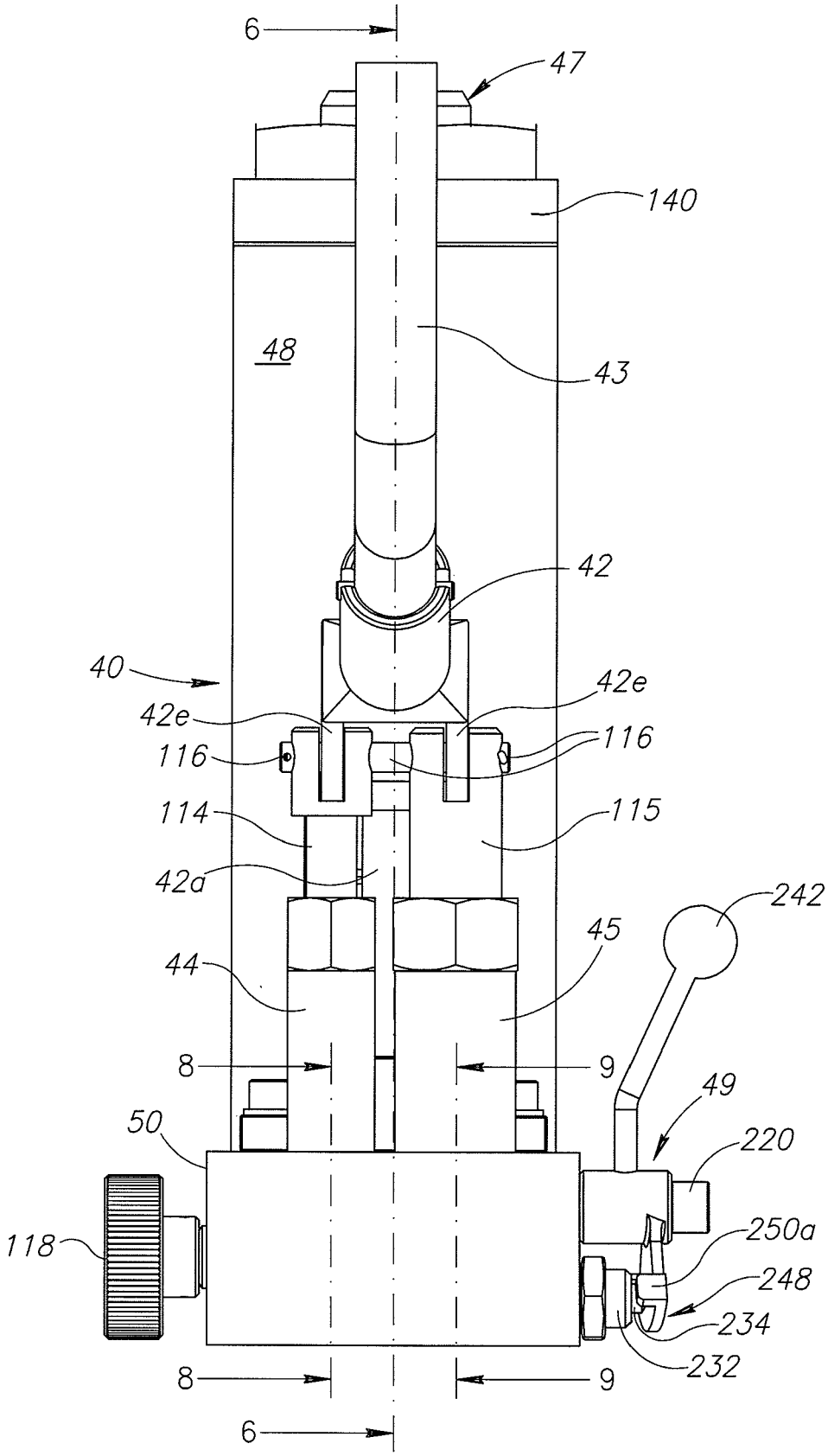
FIG. 4 is a front view of the hydraulic power unit of the apparatus of FIGS. 1A-1C and FIG. 2.
Figure 5:
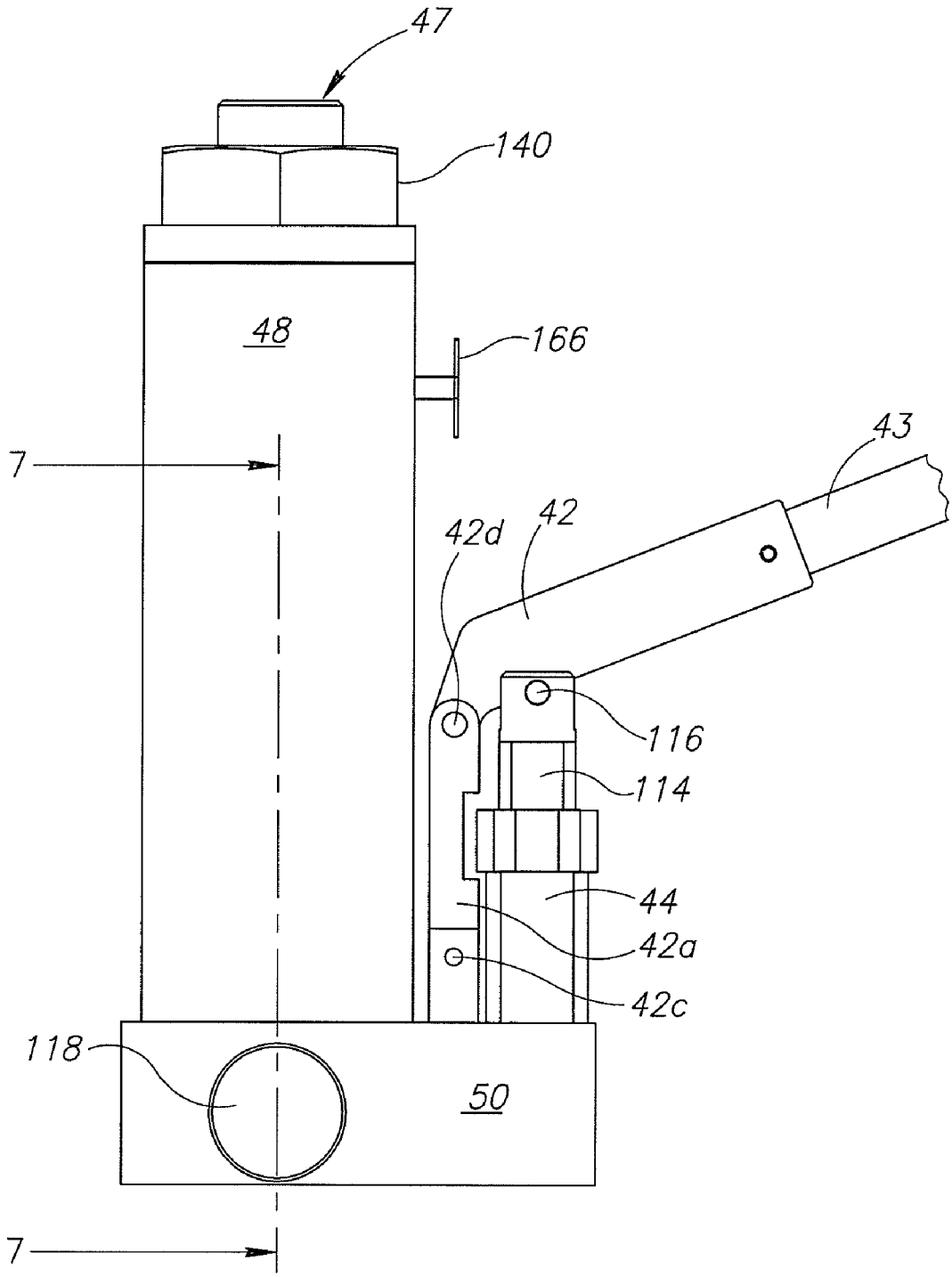
FIG. 5 is a side view of the hydraulic power unit of FIG. 4.
Figure 8:
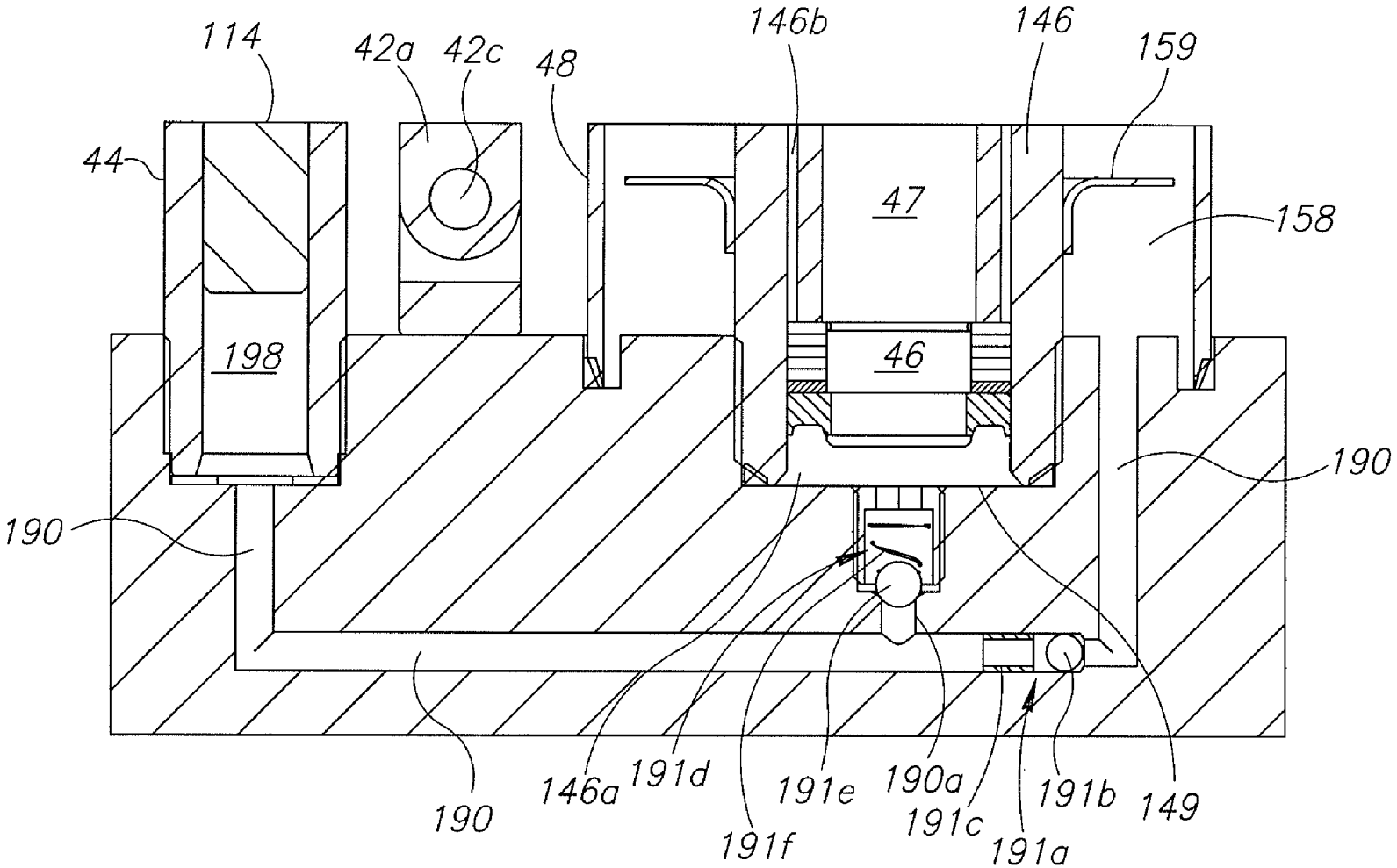
FIG. 8 is a cross sectional view of the hydraulic power unit taken along line 8-8 of FIG. 4.
Figure 9:
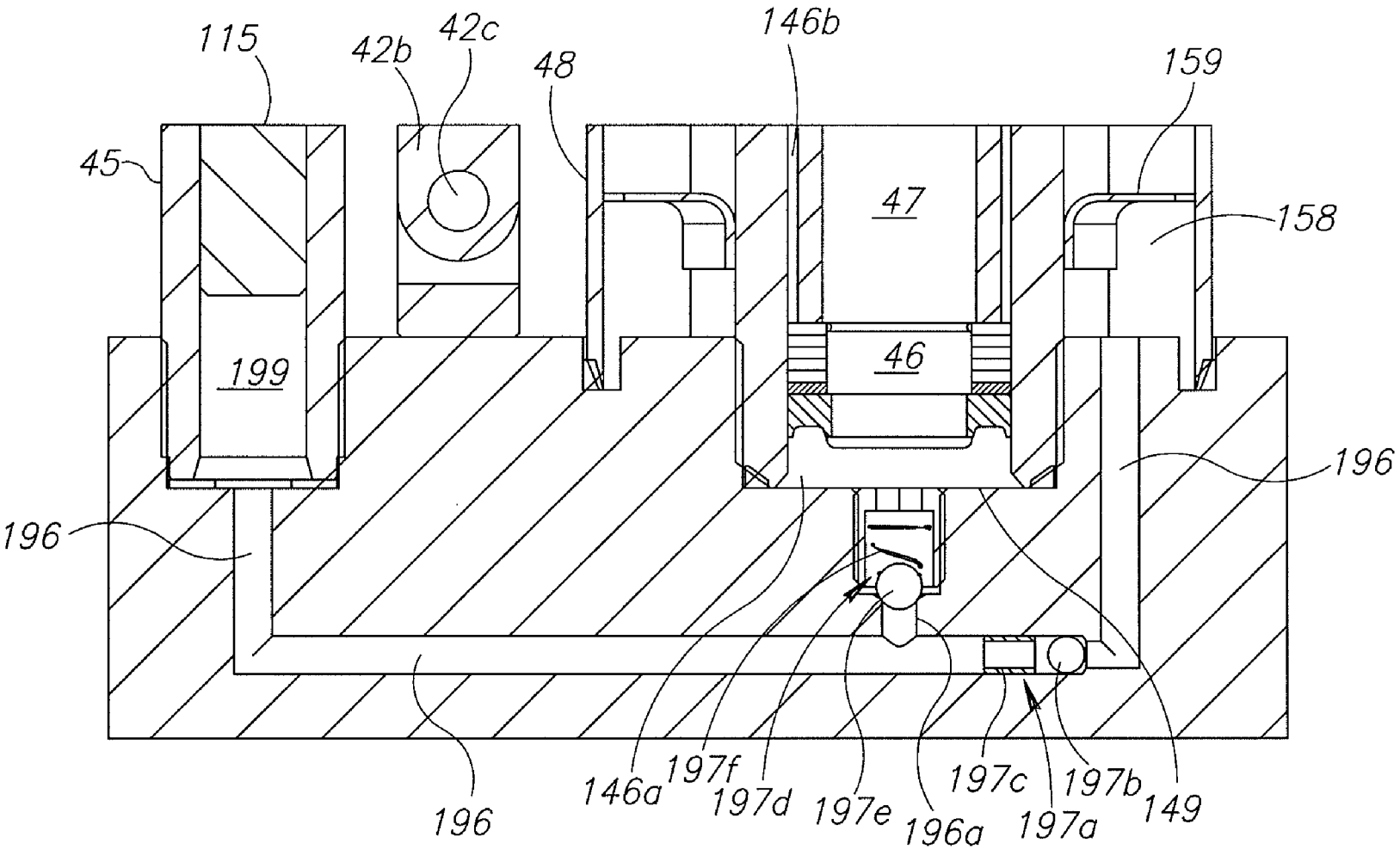
FIG. 9 is across sectional view of the hydraulic power unit taken along line 9-9 of FIG. 4.
Figure 10A:
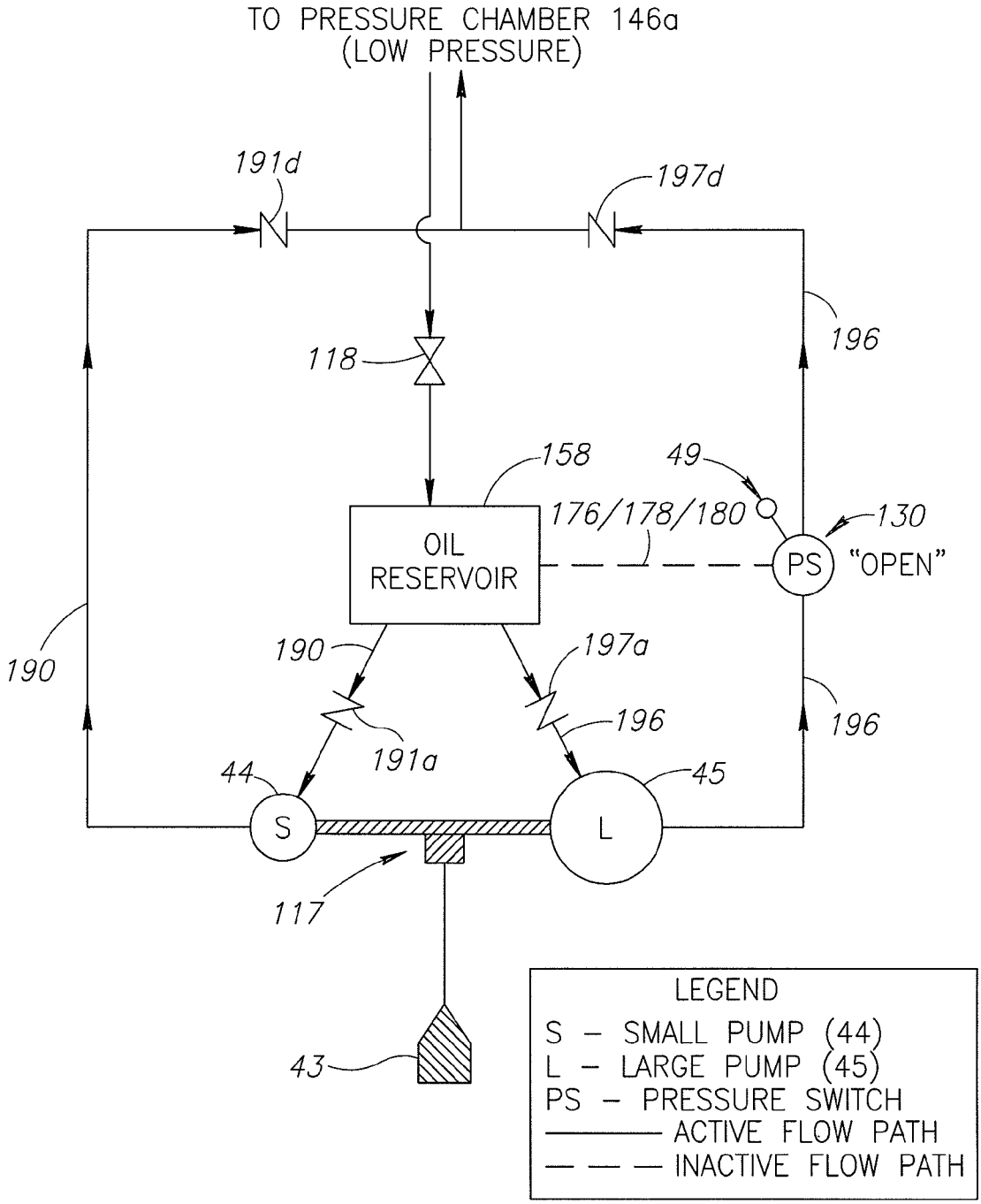
FIGS. 10A-10C are schematic diagrams of the hydraulic system of the hydraulic power unit of FIGS. 1A-1C, 2, 4 and 5.
Figure 10B:
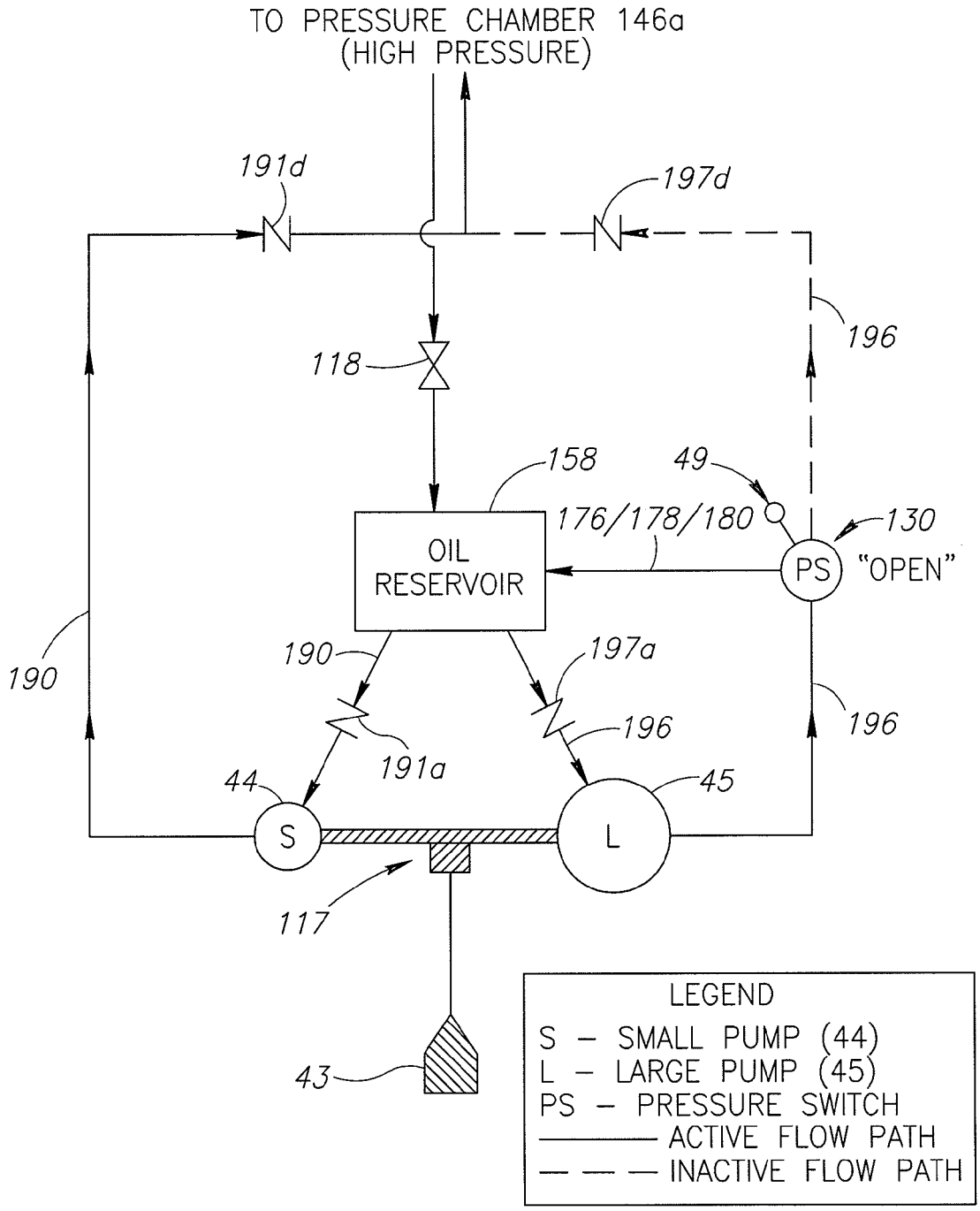
Figure 10C:
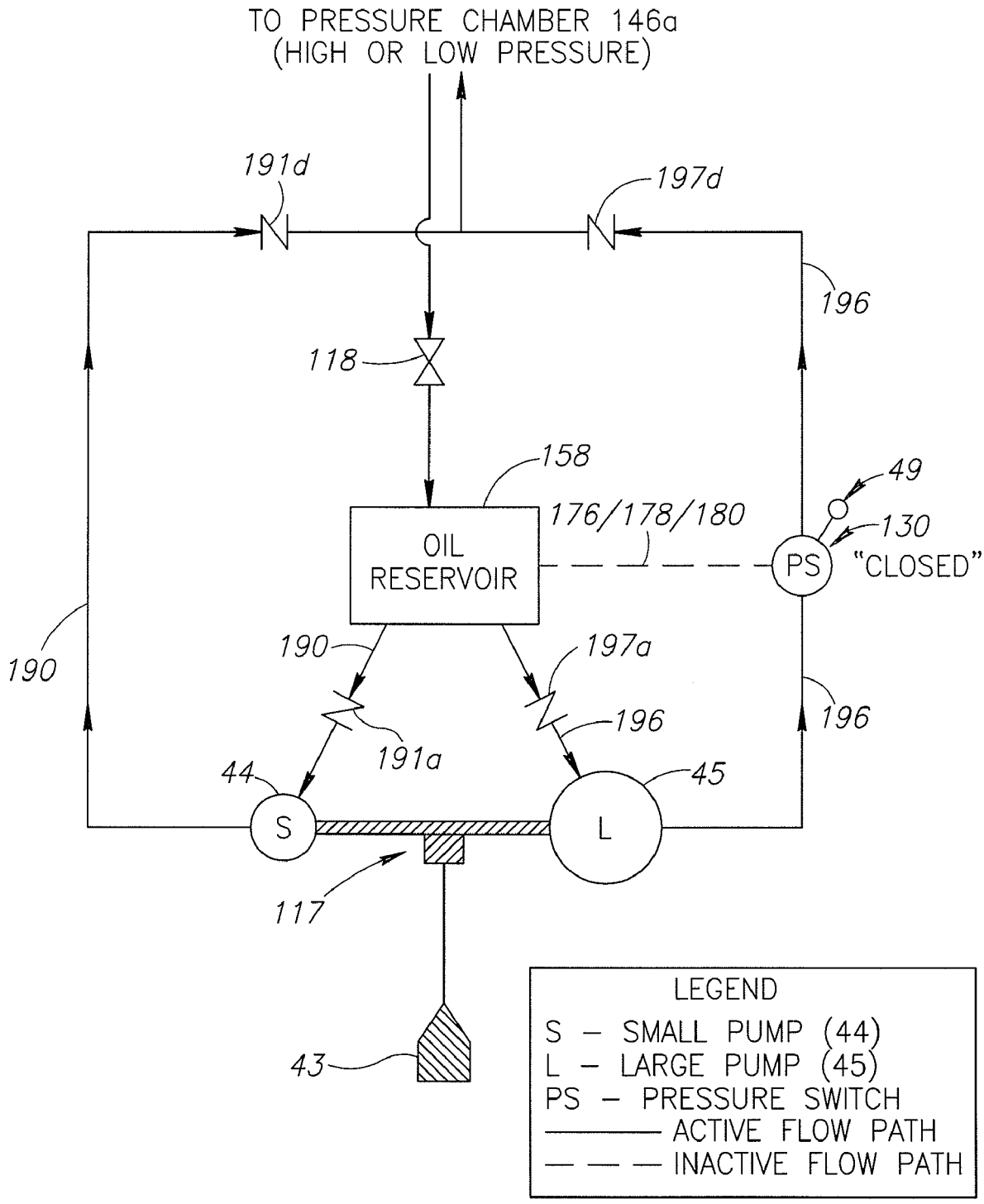

Attention is now directed to FIGS. 4-10C, where the hydraulic power unit 40 is detailed. FIG. 4 shows the hydraulic power unit 40 from the outside, with a casing 48 supported on a base 50. The ram 47 that contacts the wedge 52, extends from the casing 48. The hydraulic power unit 40 contains two piston pumps 44 and 45, a small chamber pump 44 (S) and a large chamber pump 45 (L), with their respective pump pistons 114, 115 (the large pump 45 produces a greater displaced volume than the small pump 44). Pump pistons 114 and 115, extending from each respective pump 44, 45, facilitate a dual speed hydraulic power unit 40. The pump pistons 114, 115 are connected to the yoke 42 that receives the handle 43. The yoke 42 is pivotally mounted on two links 42*a*, 42*b* pivotally attached to the base 50, to define a fulcrum for the yoke 42 and handle 43. A pin 42*c* attaches the links 42*a*, 42*b* to the base 50. A second pin 42*d* attaches the links 42*a*, 42*b* to the yoke 42. A third pin 116 attaches the yoke 42 to the pistons 114 and 115 (shown in FIGS. 1B and 1C), by extending through tabs 42*e* on the yoke 42 (FIG. 4). The yoke 42, handle 43, links 42*a*, 42*b* and pins 42*c*, 42*d*, 116, define a handle mechanism 117 (FIGS. 10A-10C). A pressure switching device, a pressure switch 130, identified within the dashed lines of FIG. 7A, further detailed in FIGS. 7B-7D, and described below, controls the performance of the larger displacement pump 45. A system pressure release valve 118, is such that it can be opened and closed manually. The pressure release valve 118 is located in the hydraulic power unit base 50.

Figure 6:
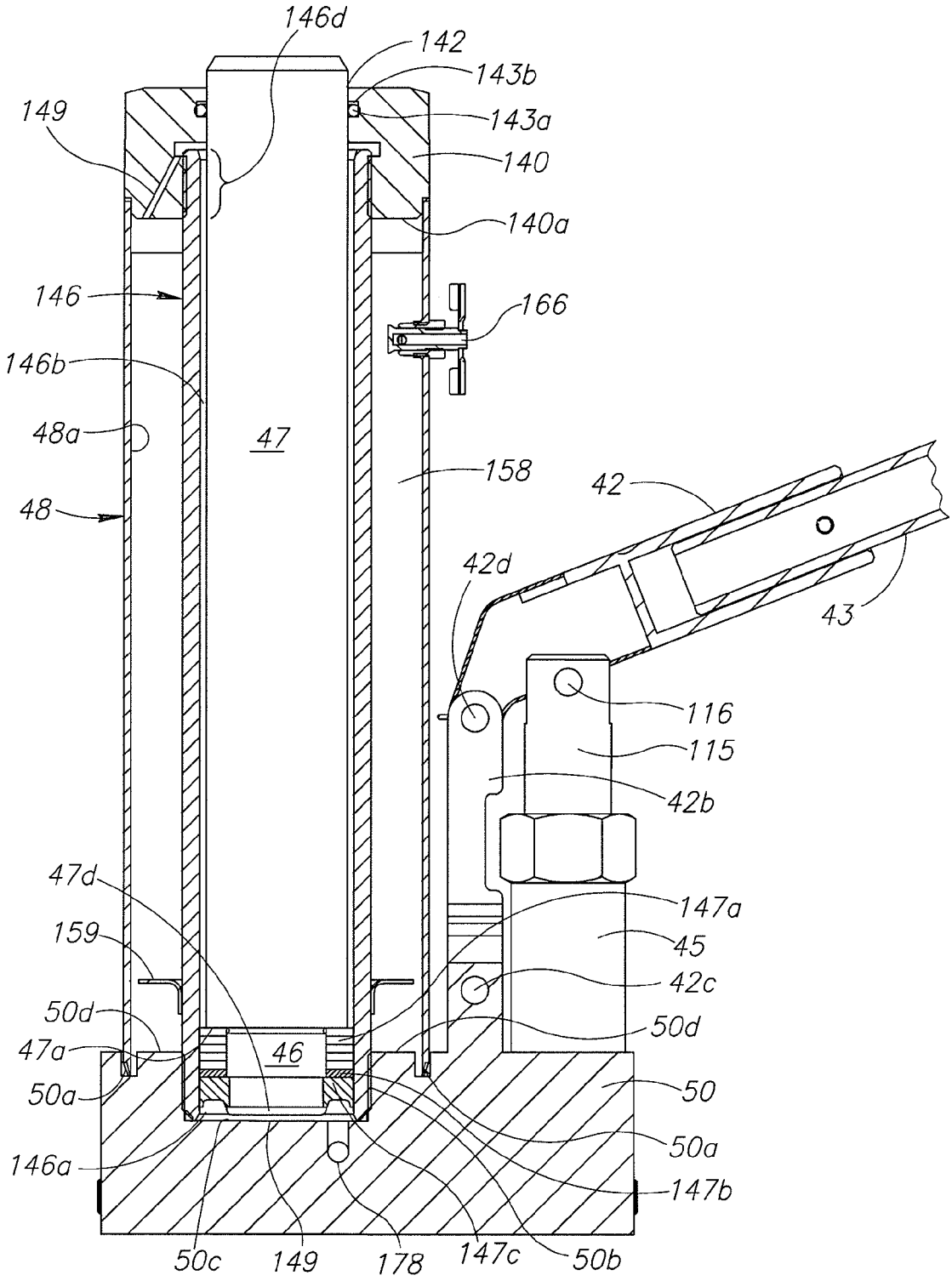
FIG. 6 is a cross sectional view of the hydraulic power unit taken along line 6-6 of FIG. 4.

Turning to FIG. 6, there is shown a cross-sectional view of the hydraulic power unit 40. In the hydraulic power unit 40, the casing 48 mounts in the indent 50*a* in the base 50. The casing 48 is covered by a cap 140 that includes an opening 142, through which the ram 47 extends. There is also an O-ring seal 143*a* in a groove 143*b* in the cap 140, to prevent dirt and debris from entering the hydraulic fluid holding chamber 158 (oil reservoir) and the pressure tube 146.

The ram 47 connects to a piston 46. The piston 46 is sealed against the inside wall of the pressure tube 146, to define a pressure chamber 146*a*, this sealing to prevent hydraulic fluid (oil) from leaking by the piston 46 into the upper portion 146*b* of the pressure tube 146 (this upper portion 146*b* of the pressure tube 146 is at ambient pressure). The sealing mechanism is formed of an aluminum ring 147*a*, a nylon washer 147*b* and a cup 147*c* of polymeric material all held in place at the top by a shoulder 47*a* on the ram 47, and a lip 47*d* at the base of the ram 47. This sealing mechanism allows the pressure chamber 146*a* to be at pressures other than ambient. The pressure chamber 146*a* is the volume in the pressure tube 146 under the sealing mechanism. The pressure tube 146, mounts in a cut out section 50*b* of the base 50. The pressure chamber 146*a* is formed in the pressure tube 146, between the lower surface of the piston 46 and the surface 50*c* of the cut out section 50*b* of the base 50. The surface 50*c* of the cut out section 50*b* defines the floor 149 of the pressure chamber 146*a*.

The hydraulic fluid holding chamber, or oil reservoirs 158 is bounded by the outer surface of the pressure tube 146, the inner surface 48*a* of the casing 48, the surface 50*d* of the base 50 and the lower surface 140*a* of the cap 140. A hydraulic fluid (oil) diffuser ring 159 is attached to the pressure tube 146 and extends into the reservoir 158. The diffuser ring 159 prevents hydraulic fluid vaporization in the oil reservoir 158 as the return springs 54 rapidly return the ram 47 and the attached piston 46 to their rest positions at the bottom of the pressure tube 146, when the pressure release valve 118 is opened by the operator at the end of a log splitting operation.

The pressure tube 146, for example, may include grooves 146*d* therein and an opening 149 in the hydraulic power unit cap 140 proximate to the grooves 146*d* to allow fluid to flow from the pressure chamber 146*a* into the reservoir 158, to limit the distance the piston 46 can extend, and accordingly, limit movement of the ram 47 out of the casing 48, as well as prevent a pressure build up and potentially an explosion. This structure is described, for example, in U.S. Pat. No. 5,946,912, the disclosure of which is incorporated by reference herein.

An air pressure vent valve 166 is located in the wall of the casing 48. This valve 166 must be opened by the operator, when the apparatus 20 is being operated either in the vertical mode, as shown in FIGS. 1A-1C, FIG. 2 and FIG. 12, or in the horizontal mode of FIGS. 11A-11C, in order to prevent the hydraulic power 40 unit from becoming air bound. This valve 166 allows air to freely enter and exit the reservoir 158 as oil enters and exits the reservoir 158 with movement of the piston 46 within the pressure tube 146. During apparatus storage, this valve 166 is closed by the operator to prevent ingestion of dirt and debris into the reservoir 158.

Figure 7A:
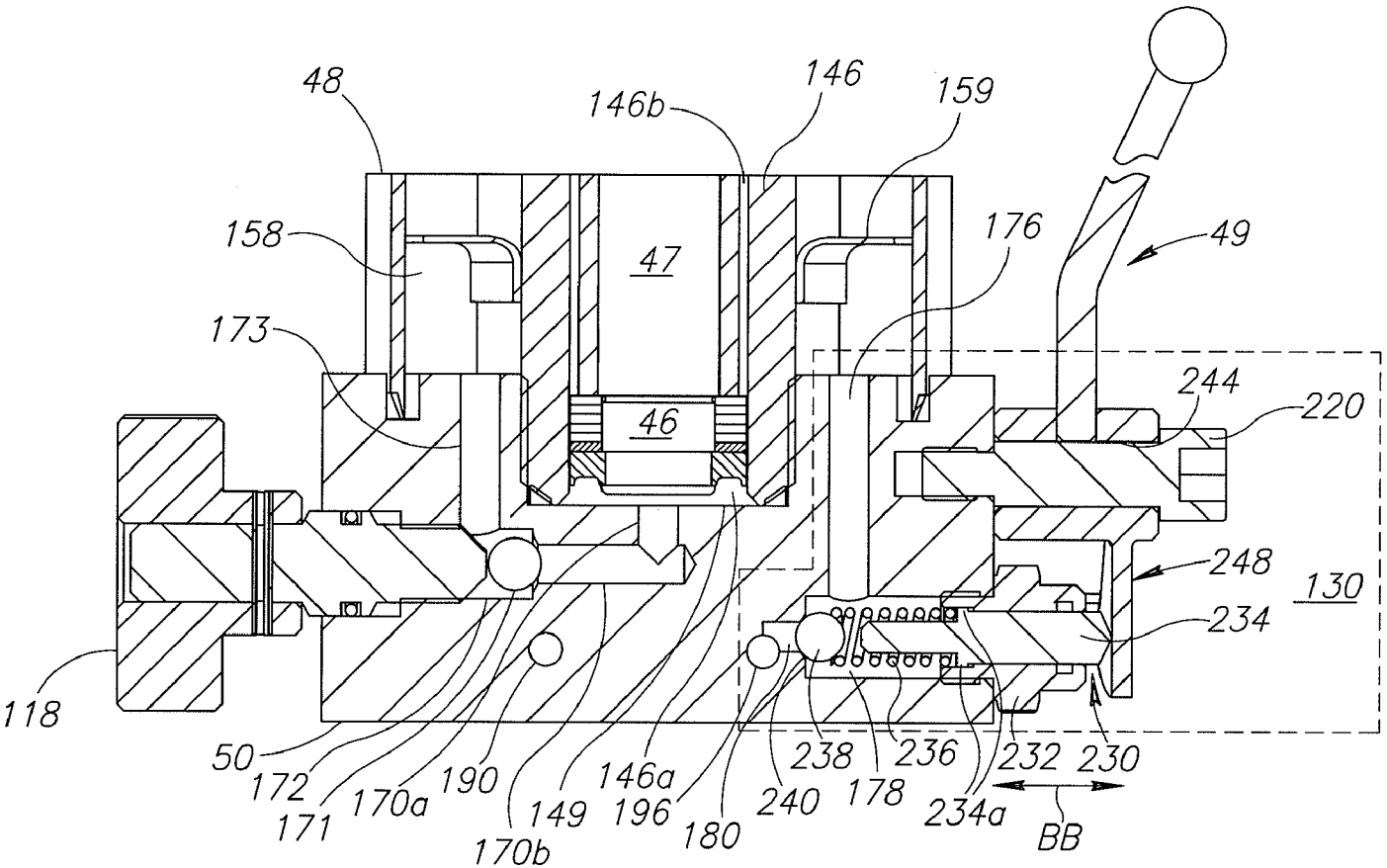
FIG. 7A is a cross sectional view of the hydraulic power unit taken along line 7-7 of FIG. 5, with the valve in a first position.

Turning also to FIG. 7A, there is shown a transport line 170*a* that extends from the pressure chamber 146*a* to the connecting transport line 170*b*. The transport line 170*b* interfaces with a check ball 171 of the pressure release valve 118. Behind the check ball 171 is a valve chamber 172. A transport line 173 extends from the valve chamber 172 to the oil reservoir 158. When the pressure release valve 118 is opened, hydraulic fluid will flow from the lower pressure chamber 146*a* to the reservoir 158, resulting in the ram 47 and the piston 46 moving from an extended position to a retracted position (for example, where the wedge 52 rests proximate to the cap 140 of the casing 48, as shown in FIG. 1A).

Figure 7B:
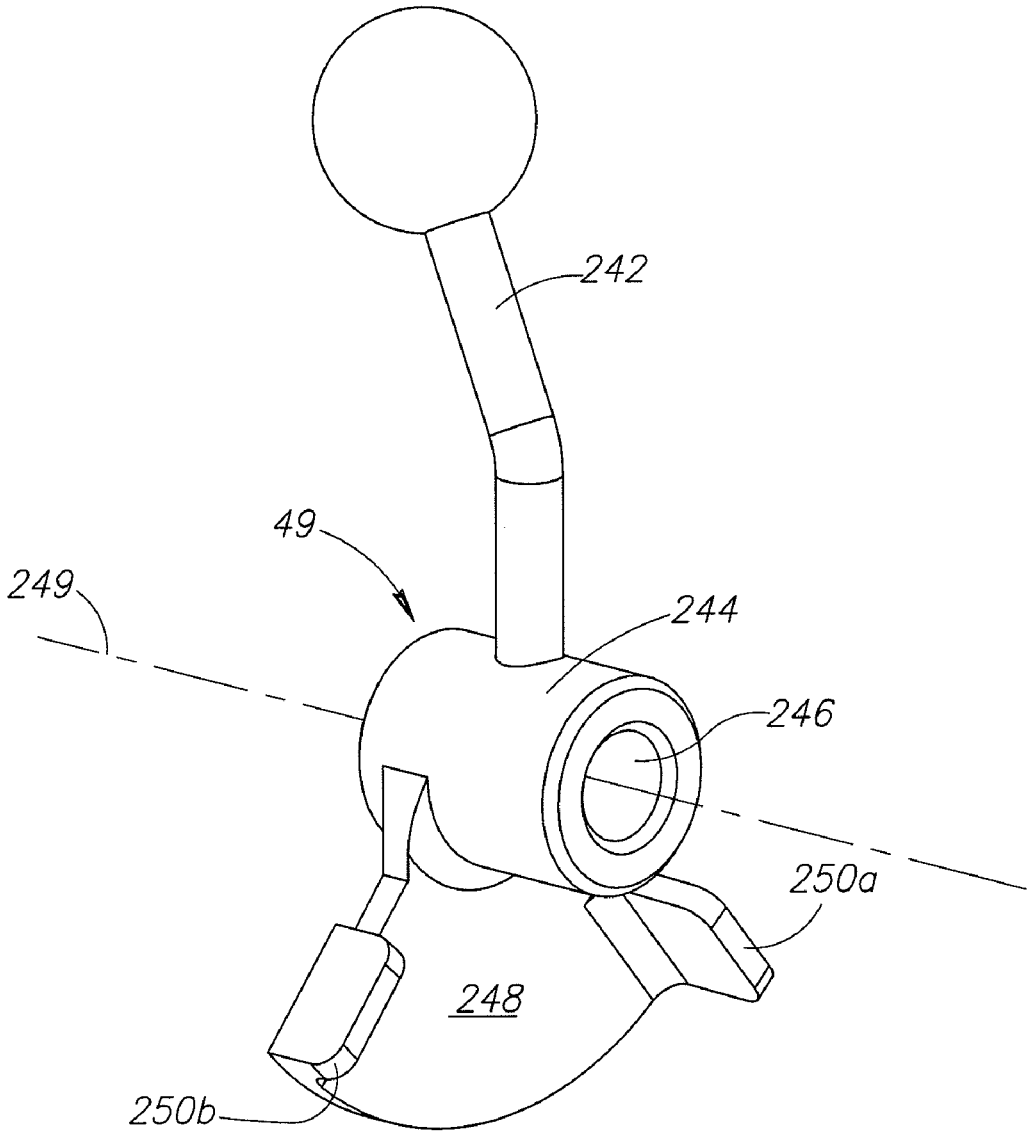
FIG. 7B is a perspective view of the handle portion of the hydraulic power unit pressure switch shown in FIG. 7A.
Figure 7C:
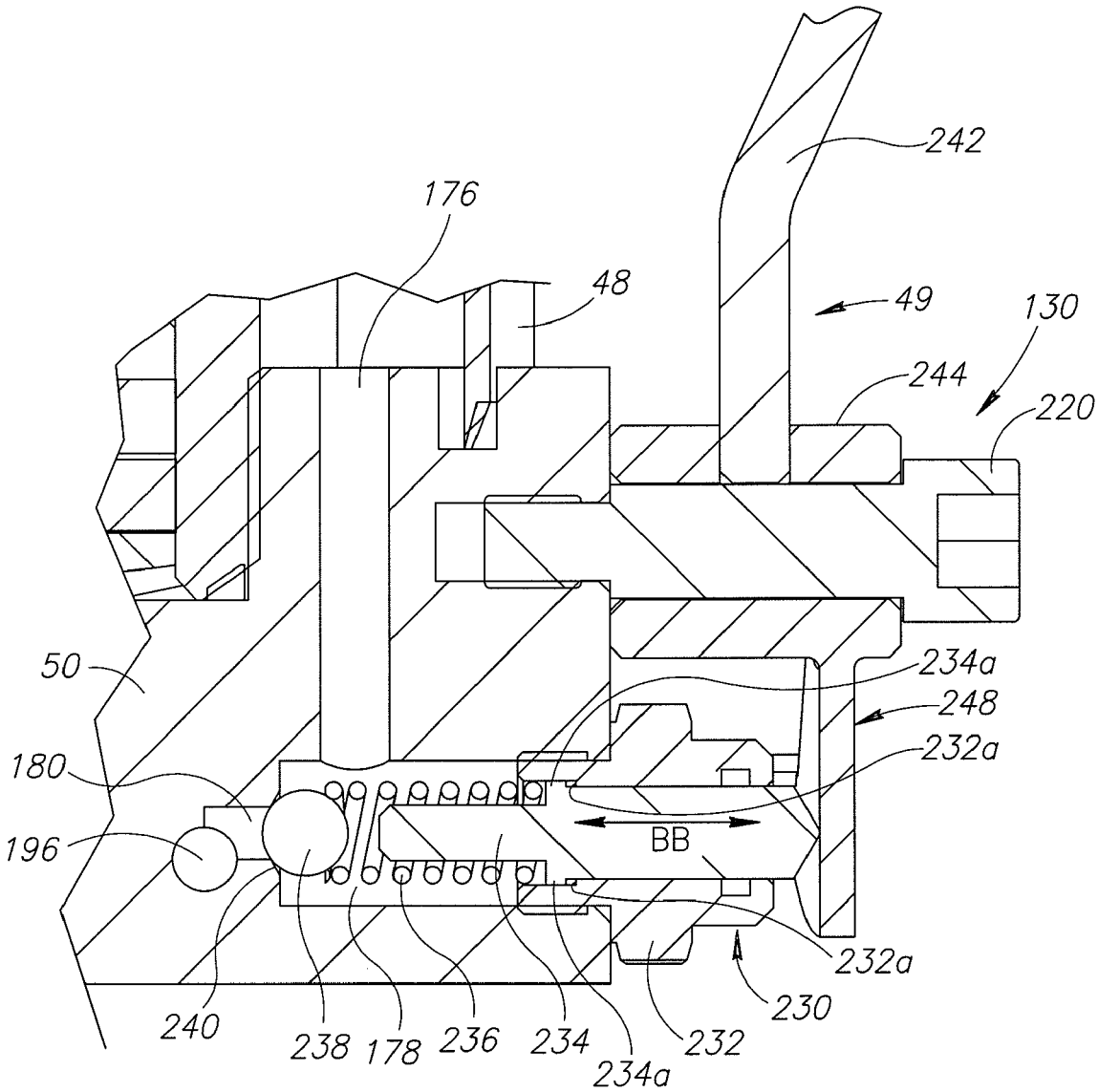
FIG. 7C is a detailed view of the pressure switch of FIG. 7A.

The pressure switch 130 is formed of a handle 49 detailed in FIG. 7B and the components shown in FIG. 7C, including a cylindrical attachment stud 220 for the handle 49, which is fastened to the base 50, and a spring loaded check ball valve 230. The valve 230 includes a switch body 232, a switch stem, or plunger 234, a spring 236, a check ball 238 and the check ball seat 240. The handle 49 is formed of a stalk 242, a cylindrical body 244 with a cylindrical opening 246 in its center, a leaf 248 fastened normally to the outer surface of the body 244 at or about a 7 degree angle relative to a plane perpendicular to the centerline 249 of the body 244, and two stop tabs 250*a* and 250*b* fastened at the ends of the leaf 248. The handle 49 rotates freely about the attachment stud 220 with its rotational travel being limited by contact of the stop tabs 250*a* and 250*b* with the switch body 232. Functionality of this three state pressure switch 130 is detailed and illustrated further below.

A hydraulic fluid transport line 176 extends from the reservoir 158 to a valve chamber 178, where the spring loaded ball check valve 230 with its valve stem 234, spring 236 check ball 238 and check ball seat 240 are located. The chamber 178 connects to a hydraulic fluid transport line 180, that in turn connects to the hydraulic fluid transport line 196 which supplies hydraulic fluid from the large displacement pump 45 to the pressure chamber 146*a*, as shown in FIG. 9.

In its first operational state, the spring loaded ball check valve 230 is shown in the "open" position in FIG. 7C (as the shoulder 234*a* of the valve stem 234 is close to or abuts the ledge 232*a* of the switch body 232), the handle 49 is rotated counterclockwise (in the direction of arrow CC as shown in FIG. 11A) and the hydraulic system is in accordance with the schematic diagram of FIG. 10A. Movement of the stem 234 of the spring loaded ball check valve 230 is in accordance with the double headed arrow BB. In this state, the large pump 45 will deliver hydraulic fluid to the pressure chamber 146*a* with the proviso that pressure in the pressure chamber 146*a* is relatively low, as noted in FIG. 10A. The spring 236 holds the check ball 238 against the seat 240. With both pumps 44, 45 working, the piston 46, the ram 47 and the wedge 52 move rapidly.

In its second operational state, the spring loaded ball check valve 230 is shown in the "open" position in FIG. 7C (as the shoulder 234*a* of the valve stem 234 is close to or abuts the ledge 232*a* of the switch body 232), the handle 49 is rotated counterclockwise (in the direction of arrow CC of FIG. 11A) and the hydraulic system is in accordance with the schematic diagram of FIG. 10B. Movement of the stem 234 of the spring loaded ball check valve 230 is in accordance with the double headed arrow BB. In this state, the large pump 45 will not deliver hydraulic fluid to the pressure chamber 146*a* with the proviso that pressure in the pressure chamber 146*a* is relatively high, as noted in FIG. 10B. The spring 236 does not hold the check ball 238 against the seat 240 with high fluid pressure against the check ball 238. With the check ball 238 off its seat 240, hydraulic fluid in the main large pump 45 transport line 196 is allowed to flow back to the oil reservoir 158 through the path created by the transport line 180, the valve chamber 178 and the transport line 176. The piston 46, the ram 47 and the wedge 52 move relatively slowly with only the small pump 44 delivering hydraulic fluid to the pressure chamber 146*a*.

Figure 7D:
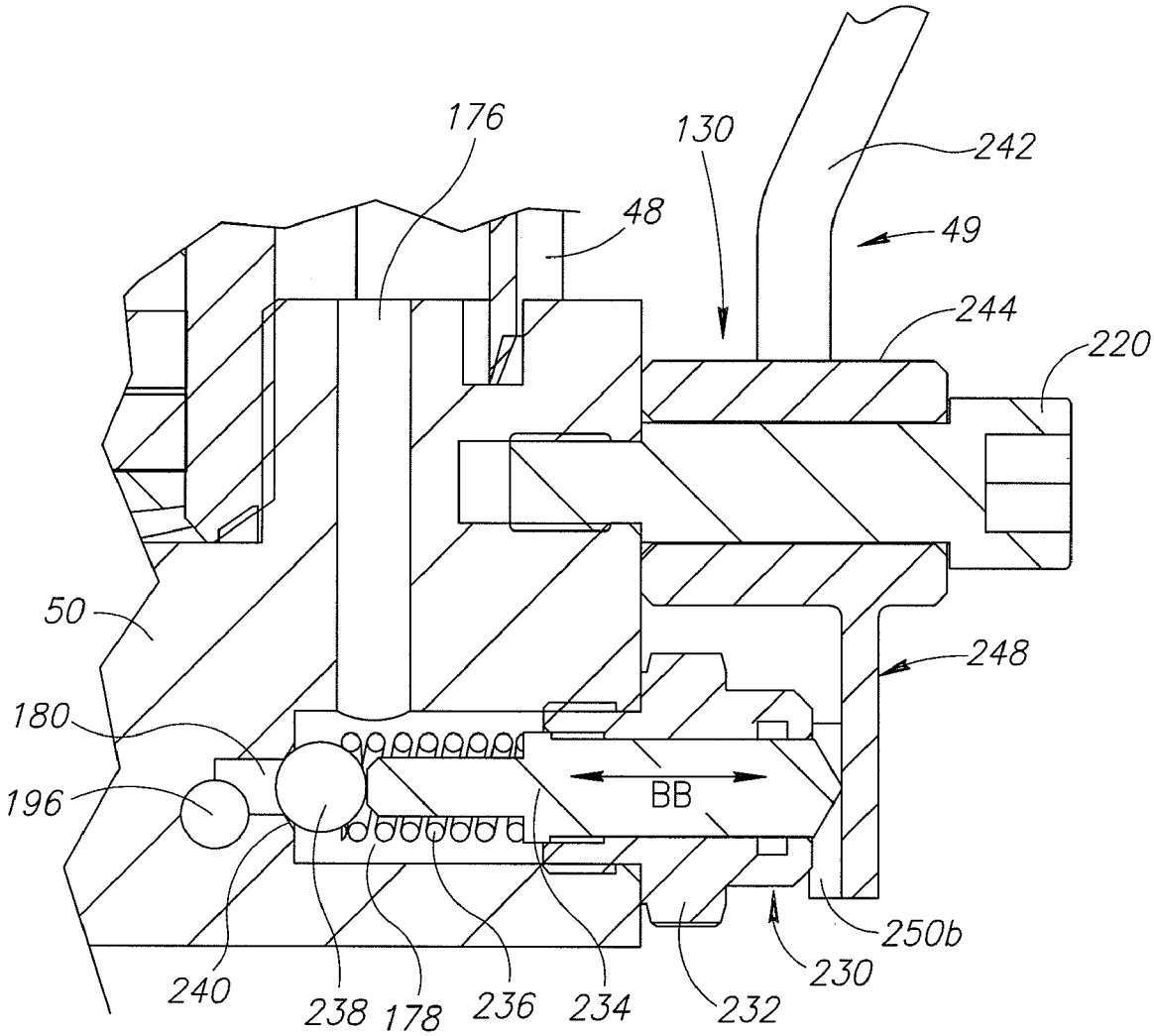
FIG. 7D is a detailed view of the pressure switch of FIG. 7A with the valve in a second position.

In its third operational state, the pressure switch handle 49 is rotated to the "closed" position (as shown in FIG. 11C, arrow DD), the switch stem 234 is driven by the leaf 248 into the switch body 232. The stem 234 mechanically forces the check ball 238 against the check ball seat 240, as shown in FIG. 7D. The stem 234 remains in abutment with the check ball 238, keeping it against the seat 240, as the other end of the stem 234 abuts the leaf 248, such that the check ball valve 230 is in the "closed" position. This action causes oil entering the large pump 45 to be forced into the pressure chamber 146*a*, independent of whether the pressure in the pressure chamber 146*a* is high or low, as shown in FIG. 10C. With both the small chamber pump 44 and the large chamber pump 45 enabled, the piston 46, the ram 47 and the wedge 52, are moved rapidly. If the pressure in the pressure chamber 146*a* is very high, the operator will be required to apply very high force to the power unit handle 43 in order to make the apparatus 20 work which is typically undesirable.

Turning to FIGS. 8 and 9, two hydraulic fluid supply lines 190 and 196 extend from the base of the two pumps 44, 45 respectively to the base of the pressure chamber 146*a*. Each of these supply lines 190 and 196 include a ball check valve 191*a*, 197*a*, each formed of a ball 191*b*, 197*b* confined by tubular retainers 191*c*, 197*c* in the respective lines 190, 196. These ball check valves 191*a*, 197*a* are biased to permit hydraulic fluid from each of the pumps 44, 45 to be drawn into the lines 190, 196 during up-stroke of the pump pistons 114, 115. During the down stroke of the pistons 114, 115, the ball check valves 191*a*, 197*a* close and the spring loaded ball check valves 191*d*, 197*d* (formed of balls 191*e*, 197*e* loaded by springs 191*f*, 197*f*) in the base 50 open to allow hydraulic fluid flow into the pressure chamber 146*a* below the piston 46, in order to drive the piston 46, and accordingly, lift the ram 47.

FIG. 8 shows the pumping chamber 198 of the small chamber pump 44 in a fluid transport pathway with the pressure chamber 146*a* and the reservoir 158. A main line 190 extends from the pumping chamber 198 to the reservoir 158, to receive fluid from the reservoir 158, while a branch line 190*a*, through which fluid is pumped into the pressure chamber 146*a*, extends off of the main line 190.

Moving to FIG. 9, there is shown the pumping chamber 199 of the large chamber pump 45 in a fluid transport pathway with the pressure chamber 146*a* and the reservoir 158. A main line 196 extends from the pumping chamber 199 to the reservoir 158, to receive fluid from the reservoir 158, while a branch line 196*a*, through which fluid is pumped into the pressure chamber 146*a*, extends off of the main line 196.

Figure 12:
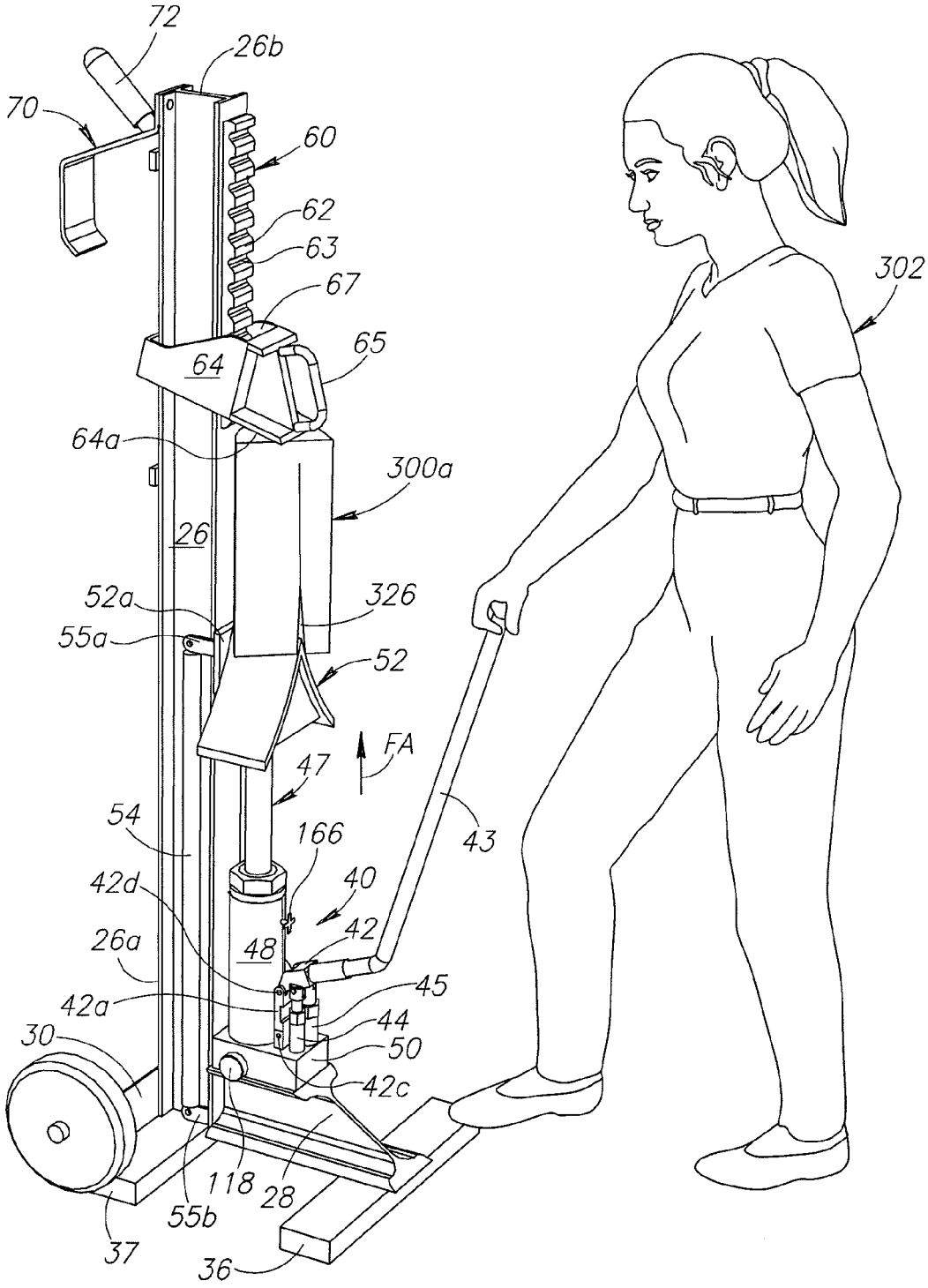

FIGS. 11A-11C and 12 further detail operation of the apparatus 20, shown in FIGS. 1A-1C and disclosed above. FIGS. 11A-11C demonstrate a log splitting operation, where a whole log 300 is split into portions, while FIG. 12 shows a split portion of a log 300*a* being further divided into kindling wood, by the apparatus 20.

In FIG. 11A the apparatus 20 has been placed in a horizontal orientation, with its wheels 34 and foot 70 resting on the ground surface 21. A log 300 is placed on the backbone 26 in abutting contact with the wedge 52. The anvil 64 is then disengaged from its initial position and moved, as described above for FIG. 2 into a position, such that the anvil tooth 67 engages a mating female indentation 63 of the rack 60, and the face 64*a* of the anvil 64 is close to or abutting the log 300.

The log splitting operation is initiated with the pressure switch handle 49 being rotated clockwise and moved in the direction of the arrow DD of FIG. 11C. This results in the butterfly leaf 248 on the switch handle 49 which is pitched at or about 7 degrees relative to a plane perpendicular to the switch handle body centerline 249, to engage and move the pressure switch stem 234, to force the spring loaded check ball 238 against its seat 240, resulting in both the small chamber pump 44 being enabled and the large chamber pump 45 being engaged, in accordance with the schematic diagram of FIG. 10C. The small chamber pump 44 creates a strong and concentrated pumping force. The large chamber pump 45 contributes much higher oil displacement and forces rapid closure between the wedge 52 and the log 300.

The operator 302 orients the pumping handle 43 as shown in FIG. 11A and pumps the handle 43 repeatedly until the operator encounters high force on the pumping handle 43. The operator 302 then lifts the pressure switch handle 49 to rotate it counterclockwise and move it in the direction of the arrow CC in FIG. 11 A, until the tab 250*a* on the pressure switch handle butterfly leaf 248 is stopped by the pressure switch valve body 232. The large oil displacement pump 45 is no longer delivering oil to the pressure chamber 146*a*. Oil from that pump 45 is being diverted to the oil reservoir 158 (as shown in FIG. 10B). The apparatus 20 is now operating at the first or slow speed with only the small chamber pump 44 filling the pressure chamber 146*a*. This moves the piston 46 and the ram 47, outward from the casing 48 at a slow speed with relatively low force required on the pump handle 43. The wedge 52, abutting the ram 47, has created the initial log split 306. The force from the wedge 52 holds the log 300 in abutment with the face 64*a* of the anvil 64. The one-way locking structure of the female indentations 63 of the rack 60 have engaged the tooth 67 of the anvil 64, such that the anvil 64 is locked in place and can not move toward the second end 26*b* of the backbone 26 (in the direction of the force). The anvil 64, and in particular, its face 64*a*, provides resistance to the force exerted by the wedge 52, such that continued pumping, (in the direction of the arrow F), drives the wedge 52 further into the log 300.

With the initial split 306 made in the log 300 shown in FIG. 1B, pumping, at the first or slower speed, continues to drive the wedge 52 into the log, forcing the two log pieces 300*a*, 300*b* further apart as shown in FIG. 11C. At some point in the splitting operation, the force required to continue to drive the log pieces 300*a*, 300*b* apart is reduced. Once the operator 302 senses this condition, the operator 302 rotates the pressure switch handle 49 clockwise as shown in FIG. 11C, arrow DD, until the stop tab 250*b* on the pressure switch handle butterfly leaf 248 encounters the pressure switch body 232. The splitting operation is now rapidly completed with both the small 44 and large 45 pump contributing oil displacement to the ram 47 and subsequently leading to rapid wedge 52 movement through an entire diameter 306*a* of the log 300. The log 300, split into portions 300*a*, 300*b*, falls off of the apparatus 20. With a complete diameter split 306*a* made in the log 300, the pressure switch handle 49 is allowed to remain in its present position as shown by FIG. 11C (toward the backbone 26) to accommodate the next splitting sequence. The ball check valve ball 238 is being held hard against its seat 240 by the pressure valve stem 234, which has been driven by the butterfly leaf 248 on the pressure switch handle 49. Thus, both the small pump 44 and the large pump 45 are contributing oil displacement into the pressure chamber 146*a*.

The next log splitting sequence commences as detailed above.

In another operational example, as shown in FIG. 12, the apparatus 20 has been placed in a vertical orientation, with its support members 36, 37 resting on the ground surface 21. A split portion of a log, for example a portion 300*a*, detailed above, is proximate to the backbone 26, and is positioned in abutting contact with the wedge 52 and the anvil 64, at opposite ends.

The pressure switch handle 49, if not oriented in a direction toward the backbone 26, is moved to this position by the operator 302. This results in the pressure switch handle 49 being rotated such that the check ball 238 of the ball check valve 230 is moved to the closed position (the ball 238 is being held hard against its seat 240 as detailed above). In this closed position, the small chamber pump 44 and the large chamber pump 45 are both enabled for pumping (in accordance with the schematic diagram of FIG. 10C).

The operator 302 orients the pumping handle 43 as shown in FIG. 12 and pumps the handle 43 repeatedly. The pumping fills the pressure chamber 146*a*, that moves the piston 46 and the ram 47, outward from the casing 48. The wedge 52, in contact with the ram 47 moves toward the log portion 300*a*. The force from the wedge 52 moves the log portion 300*a* into abutment with the face 64*a* of the anvil 64. The one-way locking structure of the female indentations 63 of the rack 60 engage the tooth 67 of the anvil 64, such that the anvil 64 is locked in place and can not move toward the end 26*b* of the backbone 26 (in the direction of the force, represented by the arrow FA). The anvil 64 provides resistance to the force exerted by the wedge 52, such that continued pumping, drives the wedge 52 into the log portion 300*a* to cause a split 326 therein, that once accelerated, results in smaller kindling portions. These kindling portions fall off of the apparatus 20.

While preferred embodiments of the disclosed subject matter have been described, so as to enable one of skill in the art to practice the present invention, the preceding description is intended to be exemplary only. It should not be used to limit the scope of the disclosure, which should be determined by reference to the following claims.

What is claimed:

1. A log splitting apparatus comprising:

a frame for supporting an anvil and a hydraulic power unit, the frame including a backbone and a foot;

a wedge for contacting and splitting a log or log portion;

a hydraulic power unit supported by the frame, the hydraulic power unit for driving the wedge, and including a pump unit, the pump unit including:

a first pump for driving the wedge at a first speed;

a second pump for contributing to drive the wedge at a second speed, the first speed less than the second speed, and means for simultaneously actuating the first pump and the second pump of the pump unit; and an anvil for restraining movement of a log or log portion.

2. The log splitting apparatus of claim 1, wherein the hydraulic power unit additionally includes:

a piston in communication with the wedge for providing force to drive the wedge;

a pressure chamber for housing the piston, the piston being moveable in the pressure chamber in response to hydraulic fluid flow into and out of the pressure chamber, the pressure chamber in communication with the first pump and the second pump, and configured for receiving hydraulic fluid sent from the first pump and the second pump; and, a spring loaded ball check valve configured for permitting hydraulic fluid flow into the pressure chamber from the second pump prior to a predetermined load being encountered by the piston and, once the predetermined load has been encountered by the piston, the first pump provides the force to the piston to overcome the applied load.

3. The log splitting apparatus of claim 2, wherein the first pump includes a pump chamber, the second pump includes a pump chamber, and the pump chamber of the first pump is of a smaller displacement volume than the pump chamber of the second pump.

4. The log splitting apparatus of claim 3, additionally comprising a pressure switch that is intermediate to the second pump and the pressure chamber and includes the spring loaded ball check valve movable between an on seat position and an off seat position, and including a manual mechanism configured to override the spring loading of the ball check valve and force the ball check valve in a fixed manner in the on seat position.

5. The log splitting apparatus of claim 4, wherein the on seat position of the spring loaded ball check valve forces hydraulic fluid flow to the pressure chamber from the second pump prior to a predetermined load being encountered by the piston, and once the predetermined load has been encountered by the piston, the hydraulic fluid flow from the first pump to the pressure chamber provides the force to the piston to overcome the applied load.

6. The log splitting apparatus of claim 5, wherein the on seat position of the ball check valve is such that hydraulic fluid is forced to flow into the pressure chamber from the second pump.

7. The log splitting apparatus of claim 6, wherein the pressure switch includes a valve stem.

8. The log splitting apparatus of claim 7, wherein the pressure switch includes a lever, the lever including a handle portion and a leaf portion, the leaf portion being angled to be in contact with a portion of the valve stem when the ball check valve is in the first on seat position and in the off seat position.

9. The log splitting apparatus of claim 1, wherein the means for simultaneously actuating the first pump and the second pump includes a single handle in communication with the first pump and the second pump.

10. The log splitting apparatus of claim 3, wherein the first pump and the second pump are independent of each other.

11. The log splitting apparatus of claim 1, wherein the anvil is configured to be adjustable along the backbone until secured in place on the backbone.

12. A method for splitting a log comprising:

providing a log splitting apparatus comprising:

a frame for supporting a position adjustable anvil and a power unit, the frame including a backbone and a foot;

a wedge for contacting and splitting a log or log portion;

a power unit for driving the wedge, the power unit including;

a piston in communication with the wedge for providing force to drive the wedge;

a pressure chamber for housing the piston, the piston being movable in the pressure chamber in response to fluid flow into and out of the pressure chamber;

a first pump of a first displacement volume in communication with the pressure chamber for sending fluid to the pressure chamber;

a second pump of a second displacement volume, the second displacement volume greater than the first displacement volume, the second pump in communication with the pressure chamber for sending fluid to the pressure chamber; and a pressure switch including a spring loaded ball check valve configured for permitting fluid flow to the pressure chamber from the second pump prior to a predetermined load being encountered by the piston, and, once the predetermined load has been encountered by the piston, the first pump provides the force to the piston to overcome the applied load; and an anvil for restraining movement of a log or log portion, the anvil configured to be adjustable along the backbone;

moving the anvil to a desired position and securing it along the backbone;

placing a log or log portion into contact with the anvil; and activating the power unit to drive the wedge into contact with the log or log portion.

13. The method of claim 12, wherein activating the power unit includes causing the spring loaded ball check valve to automatically stop fluid flow from the second pump to the pressure chamber once a predetermined load has been encountered by the piston, such that the first pump provides force to the piston to split the log or log portion.

* * * * *